United States Patent [19]

Jenness, III

[11] 4,444,108

[45] Apr. 24, 1984

[54] PRINTING APPARATUS AND PROCESS

[75] Inventor: Peter Jenness, III, Spofford, N.H.

[73] Assignee: Markem Corporation, Keene, N.H.

[21] Appl. No.: 405,189

[22] Filed: Aug. 4, 1982

[51] Int. Cl.[1] ..... B41F 1/04

[52] U.S. Cl. ..... 101/305; 101/44; 101/320; 101/327; 101/359; 101/426

[58] Field of Search ..... 101/35, 41–44, 101/9–11, 4, 291, 298, 301, 305, 314, 315, 316, 318, 320, 321, 324, 326, 327, 359, 379, 380, 426

[56] References Cited

U.S. PATENT DOCUMENTS

| | | | |
|---|---|---|---|
| 1,383,552 | 7/1921 | McDonough . | |
| 1,400,223 | 12/1921 | McDonough . | |
| 1,491,733 | 4/1924 | Payzant . | |
| 1,491,734 | 4/1924 | Payzant . | |
| 1,808,812 | 6/1931 | Glass . | |
| 1,845,726 | 2/1932 | Scott . | |
| 1,934,733 | 11/1933 | Naugler | 101/335 |
| 1,940,691 | 12/1933 | Neff et al. | 101/35 |
| 2,024,395 | 12/1935 | Silverman | 101/287 |
| 2,040,524 | 5/1936 | Mumma et al. | 101/35 |
| 2,549,107 | 4/1951 | Marsh | 101/305 |
| 2,559,455 | 7/1951 | Meyer | 101/44 |
| 2,756,674 | 7/1956 | Rieger et al. | 101/301 |
| 2,775,196 | 12/1956 | Miles | 101/212 |
| 2,787,950 | 4/1957 | Dorsch | 101/44 |
| 2,889,767 | 6/1959 | Hirschey et al. | 101/35 |
| 2,936,702 | 5/1960 | Columbus et al. | 101/44 |
| 3,092,021 | 6/1963 | Gruver | 101/216 |
| 3,101,666 | 8/1963 | Sawtelle | 101/212 |
| 3,102,468 | 9/1963 | Worth | 101/35 |
| 3,112,690 | 12/1963 | Talarico | 101/35 |
| 3,142,246 | 7/1964 | Ross | 101/76 |
| 3,168,863 | 2/1965 | McRae | 101/43 |
| 3,187,666 | 6/1965 | Pedroli | 101/44 |
| 3,191,526 | 6/1965 | Ross | 101/91 |
| 3,260,193 | 7/1966 | Mann | 101/35 |
| 3,289,582 | 12/1966 | McKay | 101/329 |
| 3,364,849 | 1/1968 | Price, Jr. | 101/35 |
| 3,457,854 | 7/1969 | Marozzi | 101/35 |
| 3,636,866 | 1/1972 | Stommel et al. | 101/22 |
| 3,648,601 | 3/1972 | Weidman | 101/35 |
| 3,706,274 | 12/1972 | Coville | 101/301 X |
| 3,724,369 | 4/1973 | Gery et al. | 101/41 X |
| 3,738,260 | 6/1973 | Navi et al. | 101/35 |
| 3,779,159 | 12/1973 | Rose et al. | 101/35 |
| 3,785,288 | 1/1974 | Hunter | 101/348 |
| 3,786,746 | 1/1974 | Roberts | 101/35 |
| 3,804,016 | 4/1974 | Marozzi et al. | 101/333 |
| 3,878,782 | 4/1975 | Coffelt | 101/235 |
| 3,911,812 | 10/1975 | Flynn et al. | 101/42 X |
| 4,004,511 | 1/1977 | de Groot | 101/301 X |
| 4,023,490 | 5/1977 | Marozzi | 101/235 |
| 4,047,479 | 9/1977 | McKay et al. | 101/36 |
| 4,073,122 | 2/1978 | Areson | 101/44 X |
| 4,178,847 | 12/1979 | Erhardt | 101/91 |
| 4,271,757 | 6/1981 | Maxwell et al. | 101/37 |
| 4,323,011 | 4/1982 | Hamilton | 101/305 |

OTHER PUBLICATIONS

Markem Corporation Model 146A Machine Manual (May 1967).

Markem Corporation Model 300T Machine Manual (Nov. 1976).

Markem Corporation Model U-1228 Machine Manual (Dec. 1977).

Markem Corporation Model U-1251M Operating Instructions (Not Dated).

Markem Corporation Model 3111 Machine Manual (Sep. 1979).

Markem Corporation Model 3201 Machine Manual (Oct. 1980).

*Primary Examiner*—Clifford D. Crowder

*Attorney, Agent, or Firm*—Robbins & Laramie

[57] ABSTRACT

A printing apparatus is disclosed wherein rocking motion of a movably mounted inking roll assembly is controlled by a cam and follower arrangement coupled to the drive system for a pivoting printing member. The cam and follower arrangement allows coordinated movement of the printing member and inking roll assembly to be obtained in a simple manner and without employing separate drive means for rocking the inking roll assembly. The cam contour is advantageously chosen so that the inking roll is moved gradually toward and then away from the pivot axis of the printing member as the line of contact between the printing element and the inking roll progresses from the leading edge of the printing element to the trailing edge. Such movement of the inking roll maintains uniform tangential contact between the inking roll and the entire surface of a flat printing element as the latter is moved in an arcuate path by the printing member. Also disclosed is a resilient mounting arrangement for the printing member which allows movement of the printing member along separate arcuate and straight-line paths at different times under the control of a single drive means.

18 Claims, 26 Drawing Figures

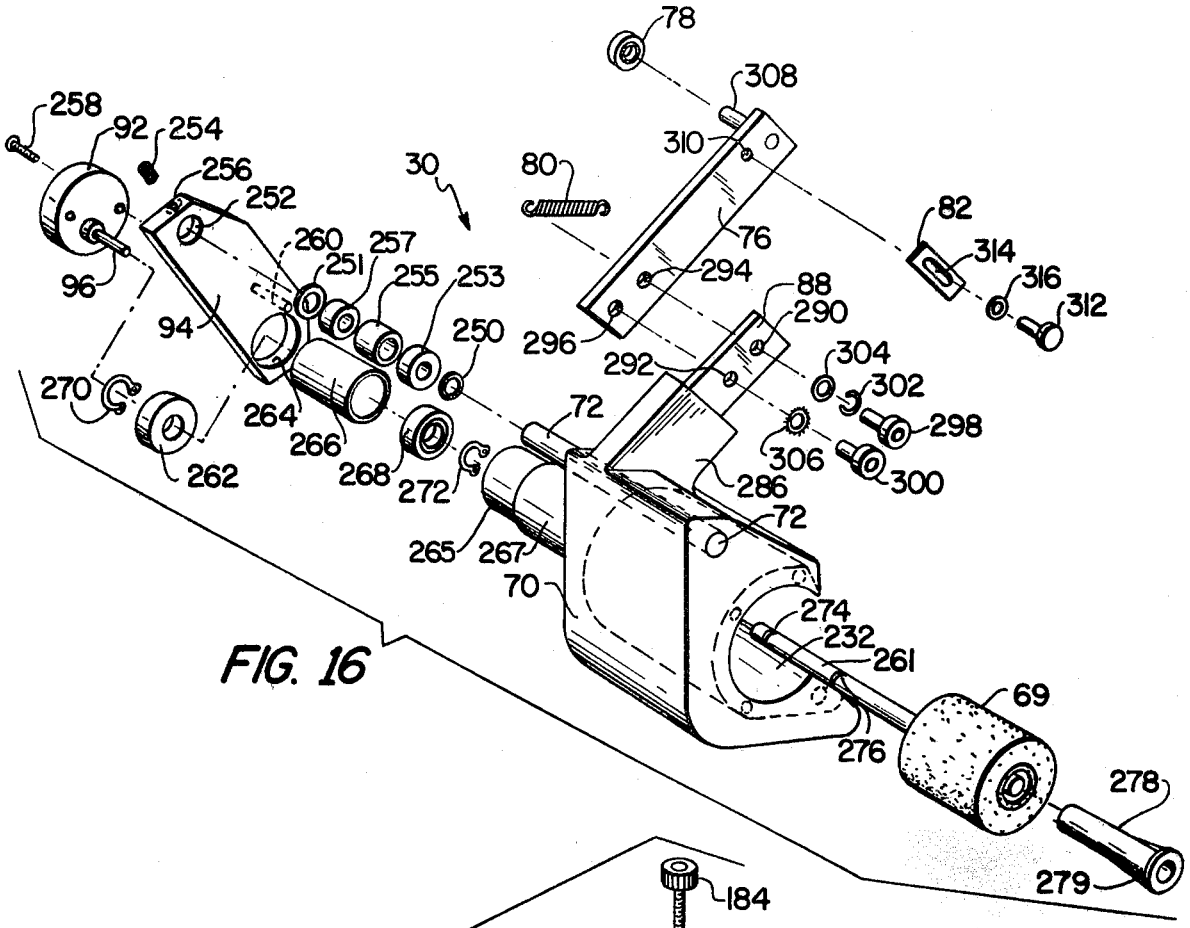
FIG. 16
FIG. 14
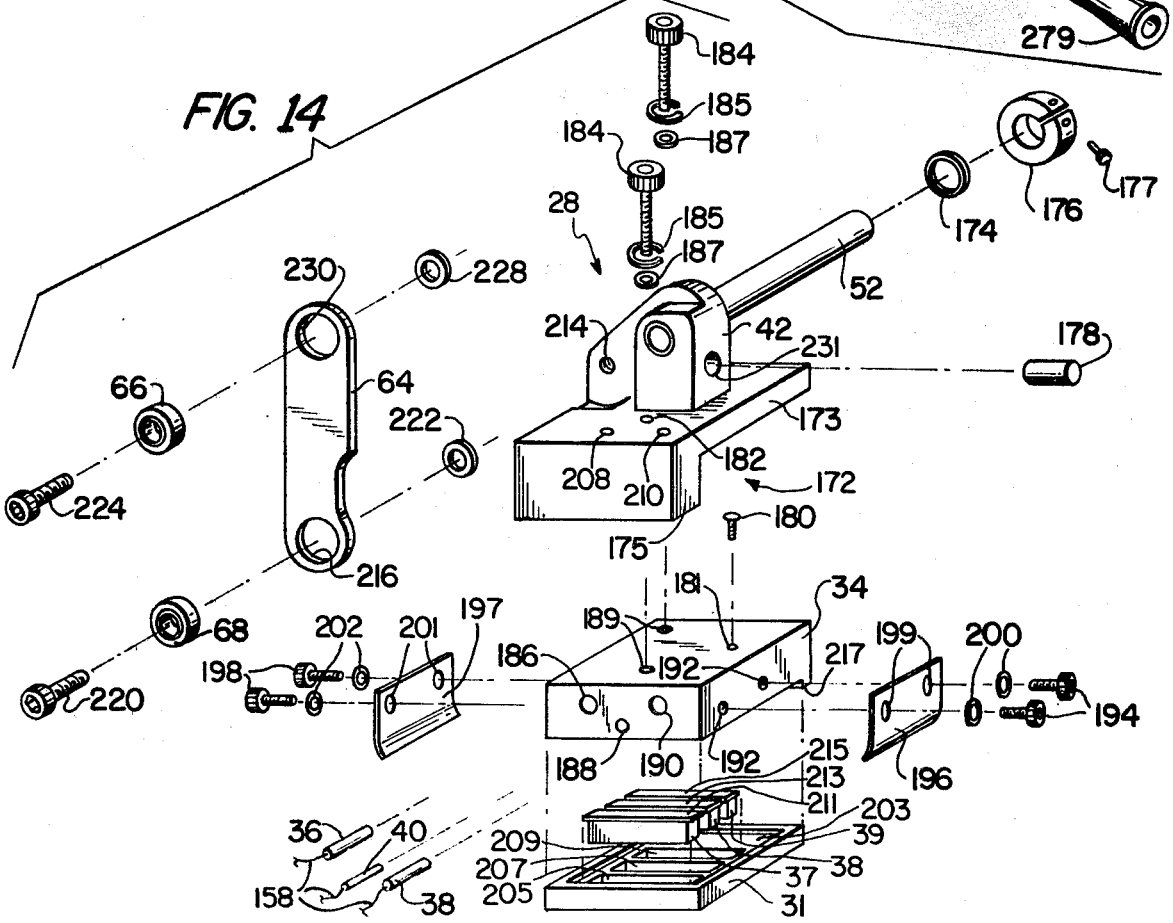

300 MSEC (MAX)
372
364
Cx2
Q2
+TR
RxCx2
RESET 2
VDD
4538
-TR2
VSS
C6
R5
12v
C5
I SEC (MAX)
368
R4
+12v
Cx1
Q1
+TR1
RxCx1
-TR1
RESET 1
DELAY
P2
R3
C2
360
362
358
SELECT
C4
R16
C1
4011
354
356
372
R15
C3
R51
370
352
366
RUN/STOP
R1
R2
350
TO HALL SWITCH 84
TO AUX HALL SWITCH

PRINTING APPARATUS AND PROCESS

BACKGROUND OF THE INVENTION

1. Field of the Invention

The present invention relates generally to a printing apparatus and process, and is particularly concerned with an apparatus and process for printing date codes and other types of identifying indicia on the surfaces of webs or discrete articles carried by an intermittently moving conveyor.

2. Description of the Prior Art

In many types of product manufacturing, packaging, and handling operations it is necessary to print some sort of identifying indicia on the products in addition to the usual pre-printed labels, packaging material and so on. In some cases the required indicia consists of a number or code signifying something about the product, such as a unit price, or the process used to manufacture the product, or perhaps the particular place dwhere the product was manufactured. More frequently, as in the case of perishable food products or pharmaceuticals, the indicia consists of a date code, signifying either the date of manufacture or the last date on which the product can be sold or used. These dates are quite familiar to the consumer as the expiration dates which commonly appear on containers for dairy products, medicines, and other products with a limited shelf life.

Since the date to be printed will usually be changed very frequently, as for example daily, it is impractical to pre-print this information on boxes, labels or other previously prepared types of packaging material. For this reason, various types of printing or marking devices have been developed for rapidly and efficiently printing date codes and similar types of information on products or product containers at some point during the manufacturing or packaging operation. For example, the date codes may be printed in blank locations on a continuous web of pre-printed product wrappers or labels before the individual wrappers or labels are cut from the web and applied to the products. In other cases, the date codes may be printed on the products or product containers after all of the various manufacturing, packaging and labeling operations have been completed.

A common prior art technique for carrying out rapid printing or marking of webs or discrete articles is to provide the printing member in the form of a rotating element, such as a rotating die roll, which carries a printing die or other type of printing device on its peripheral surface. In this type of system, articles transported by a moving conveyer system, or discrete sections of a moving web, are successively brought into contact with the moving printing die after the latter has been inked by a suitable inking mechanism. This approach, which depends essentially upon rolling contact between the printing die and the surface being marked, obviously requires that the conveyer be kept in motion, preferably continuously but at least during the time that the printing die is in contact with the article or web surface. In either case, great care must be taken to equalize the peripheral velocity of the printing die with the velocity of the surface to be printed, since blurring of the printed image can occur if these velocities differ substantially. Another difficulty with this type of system is that, if the printing member and the article or web conveyor are to operate at fixed velocities, the spacing between adjacent articles must be equal to the spacing between adjacent printing dies on the die roll, which is an undesirable constraint in some instances. Measures can be taken to avoid this limitation, such as by moving either the die roll or the conveyor intermittently rather than continuously. Although intermittent motion of the die roll or conveyor is an effective means for avoiding the spacing limitation, there is a concomitant increase in the complexity of the system. In addition, with repeated acceleration and deceleration of the die roll or conveyor, the necessary equality between the article or web velocity and the peripheral velocity of the die wheel during printing becomes more difficult to achieve.

Other types of prior art marking devices have utilized reciprocating or stamping mechanisms for the printing member, as distinguished from the rotary-type printing systems described earlier. Since reciprocating or stamping mechanisms are generally intended to print on stationary surfaces, they are often preferred in cases where an intermittently moving conveyor is used to transport the articles or web to be printed. For example, the printing operation may be preceded or followed by another operation requiring temporary stopping of the conveyor motion, such as a container filling or sealing operation, and in these instances intermittent movement of the conveyor may be unavoidable. In situations like these, the temporary stopping of the conveyor provides a convenient interval during which printing can be carried out on the article or web surface by a reciprocating or stamping mechanism, with inking of the printing die occurring either at some point during the printing cycle or between successive printing cycles.

The inking of the printing die usually presents somewhat more of a problem in reciprocating or stamping mechanisms than it does in simple rotary printing systems. In the latter type of system it is merely necessary to position an inking device in a fixed location that is tangential to the rotary path of the printing die, which will suffice to apply ink to the die once during each full rotation or cycle of the printing member. In reciprocating or stamping type systems, however, the printing member generally moves in a back-and-forth manner along a path which may consist of a straight line, an arc, or some sequence or combination thereof. If the position of the inking device were to be fixed relative to the path of the printing member, the printing die would contact the inking device twice during each printing cycle, once during the forward movement of the printing member and again during its reverse or return movement. This can present difficulties in cases where the inking device consists of an inking roller which is arranged for powered rotation in only one direction by a motor, gear train, or the like, since smooth rolling contact between the printing die and the periphery of the inking roll is possible only when both are moving in the same direction. An additional problem is that at least a portion of the path of the printing member is usually in a direction normal to the plane of the printing die, which makes it difficult to position the inking device so that it will properly apply ink to the surface of the printing die without physically obstructing the movement of the printing member.

For these reasons, various types of movably mounted inking devices have been proposed for use in reciprocating or stamping type article printing systems. Generally, the movement of the inking device is such that inking occurs only once during each cycle of movement of the printing member, with the inking device being withdrawn to a non-inerfering position relative to the printing member during the remainder of the printing cycle. For example, it is common to provide a movable inking pad or roller which is arranged to be swung into momentary contact with a printing member while the latter is temporarily held stationary at an inoperative or non-printing position. In an alternative arrangement, a movable inking roller is oscillated between a retracted position within a fixed ink reservoir and an extended or operative position in the path of a moving printing member, with the movement of the inking roller being such that ink is applied to the printing die only during the forward stroke of the printing member toward the article to be printed. This arrangement differs from the previously-described systems of swinging ink pads or rollers in that the ink is applied to the printing die while the printing member is moving in the direction of the article to be printed, rather than at a stationary point of the printing member.

Still another approach to the problem of applying ink to the printing die in a reciprocating or stamping type system is to provide the die carrying member with an arrangement for alternately raising and lowering the printing die as the die carrying member moves back and forth between an inking roll and an article to be printed, thereby ensuring that the die is inked only once during the printing cycle. In other words, an additional motion of the printing member is utilized in order to allow the inking device to remain in a fixed position. This arrangement does effectively avoid the problems referred to above, but only at the expense of greater complexity in the design of the die carrying member to achieve the desired motion of the die relative to the inking roll.

Another problem that is encountered with article marking systems, or indeed with any type of printing system in which ink must be applied to a printing element such as a printing die or a row of type, is that of obtaining uniform application of ink to the entire surface of the printing element. This problem is particularly troublesome where the printing element is substantially flat, and where the inking device is in the form of a cylindrical roller which is intended to be brought into tangential rolling or wiping contact with the surface of the printing element as the latter is moved in an arcuate path by a pivoting printing arm, die roll, or the like. It is intuitively apparent that a flat printing element, moving in an arcuate path about a fixed axis, cannot be maintained in uniform contact with the periphery of a fixed inking roll as the line of contact between the two moves across the surface of the printing element. On the contrary, since the leading and trailing edges of the printing element are effectively at a greater radius from the axis of rotation of the printing arm or die roll than the median line of the printing element, the contact pressure between the printing element and the inking roll will gradually decrease as the line of contact between the two moves from the leading edge of the printing element to the median line, perhaps to the point where the printing element and inking roll will begin to physically separate, and will then gradually increase as the line of contact progresses toward the trailing edge of the printing element. As a result, if the contact pressure is set to the desired amount at the leading and trailing edges of the printing element, there will be insufficient contact pressure at the median line of the printing element. Conversely, if the contact pressure is set to the desired amount at the median line of the printing element, the contact pressure will be excessive at the leading and trailing edges of the printing element. In either case, the result is usually nonuniform inking of the printine element.

The prior art approach to the problem of nonuniform inking has usually been to limit the size of the printing die or type row relative to its radius of rotation, so that the nonuniformity in contact pressure, while still present, is at least minimized. Another approach is to provide the inking roll and/or the printing element with a resilient surface in order to maintain at least some degree of contact between the two despite variations in the contact pressure. Neither of these approaches has proved to be entirely satisfactory. Still another approach is to provide the printing element with a slight curvature, with the radius of curvature corresponding to the effective radius of the pivoting printing arm or die roll. Although this is indeed effective to alleviate the problem of nonuniform inking, curved printing dies are more difficult to fabricate than flat dies and can only be used with a printing arm or die roll having the proper radius. In the case of rotary-type printing devices employing flat printing dies, a compensation system has been devised wherein the rotation of the die-carrying member is controlled by a fixed cam which gradually shifts the axis of rotation to the die-carrying member to assure uniform contact between the printing die and adjacent inking and offset rolls. However, this type of compensation system is not conveniently applicable to reciprocating or stamping type printing mechanisms, since it involves adding additional complexity to a printing member which may already be required to move in a complicated curvilinear path between the inking device and the article to be printed.

To be commercially acceptable, product marking devices are required to be relatively inexpensive, simple to repair and maintain, and above all, reliable and trouble-free. The requirements of serviceability and reliability, in particular, are readily understood when it is realized that a product marking unit will typically be used by a product manufacturer who may have little or no understanding of its construction or operation, but who will stand to lose a great deal if a malfunction in the product marking unit were to force a temporary shutdown of the entire product manufacturing operation. This kind of occurrence must, of course, be avoided at all costs. By and large, the product marking machines to be found in the prior art are characterized either by overly complex mechanisms which are prone to failure, or, on the other hand, by mechanisms which, although simple in construction, are lacking in features necessary to assure proper and efficient operation, such as compensating arrangements for assuring uniform application of ink to flat printing elements.

SUMMARY OF THE INVENTION

The present invention provides an article marking apparatus characterized by a comparatively simple and rugged manner of construction, while at the same time providing features normally associated with more complex and sophisticated types of printing mechanisms. A particularly important feature is a compensating arrangement for assuring uniform application of ink to the printing element, which, in contrast to the prior art, is made possible without introducing any additional complexity into the motion of the printing member that carries the printing element. Other advantages of the invention include the use of a single drive means for achieving coordinated cyclical motion of the printing member and a movable ink applying device, and the use of a resilient mounting arrangement for allowing a pivoting printing member to move along separate arcuate and straight line paths under the control of a single drive means.

In one aspect, the present invention is directed to a printing apparatus in which a pivoting printing member and a rocking ink applying device are both arranged for cyclical movement in timed relation to one another under the control of a single drive means, with the movement of the printing member and ink applying device being such that ink is applied only once to a printing element carried by the printing member during any given printing cycle. The printing apparatus includes, in particular, a supporting frame and a printing member, the latter carrying a printing element such as a printing die or a line of type for forming printed images on the articles or web locations to be printed. The printing member is arranged for back-and-forth pivoting movement about an axis relative to the supporting frame along an arcuate path between a first position in proximity to an article to be printed and a second position remote from the article. A drive means is provided for cyclically moving the printing member in opposite directions along the arcuate path from the first position to the second position and then back to the first position. The drive means includes a source of rotary power having an output shaft, such as an electric motor.

The printing apparatus also includes an ink applying device in the form of an inking roll assembly which is mounted for rocking movement relative to the supporting frame along a path which intersects the arcuate path of the printing member. The inking roll assembly includes a rotatable inking roll for applying ink to the printing element carried by the pivoting printing member. Actuating means coupled to the printing member drive means is provided for cyclically rocking the inking roll assembly in timed relation to the movement of the printing member, with the rocking of the inking roll assembly being such that the inking roll is maintained out of contact with the printing device during movement of the printing member in one direction and is brought into rolling contact with the printing device in order to apply ink thereto during movement of the printing member in the opposite direction. The actuating means compises a rotatable cam affixed to the output shaft of the rotary power source, a follower arm having a cam follower at one end thereof, and biasing means for urging the cam follower into contact with the cam. The follower arm is attached at its opposite end to the inking roll assembly in order to impart rocking motion thereto in response to the rotation of the cam.

By virtue of the above described cam and follower arm arrangement, the rocking movement of the inking roll assembly is accurately coordinated with the movement of the printing member to achieve inking of the printing device only once during each printing cycle. At the same time, the need for separate drive means for imparting rocking movement to the inking roll assembly is avoided. This alone is an important simplification over certain prior art arrangements in which separate drive means were required for operating the movable inking devices. However, the present invention possesses the further advantage that, by proper selection of the cam contour, the movement of the inking roll assembly can be made to occur in a manner such that uniform application of ink to the printing device will be assured. This is particularly useful in the usual case where the printing element is in the form of a flat planar die, row of type, or the like having raised printing indicia on the surface thereof. Such a printing element will include leading and trailing edges, the leading edge being the edge which first contacts the inking roller during movement of the printing member between the first and second positions, and the trailing edge being the edge which last contacts the inking roller during such movement of the printing member. In such cases, the contour of the cam is advantageously chosen to cause the inking roller to move gradually closer to the pivot axis of the printing member as the line of contact between the inking roller and the printing element moves from the leading edge of the printing element to the median line between the leading and trailing edges thereof, and to move gradually farther away from the pivot axis of the printing member as the line of contact between the inking roller and the printing element moves from the median line of the printing element to the trailing edge thereof. In this way, uniform tangential contact is maintained between the inking roller and all points on the surface of the printing element between the leading and trailing edges thereof, thereby assuring the uniform application of ink to the printing element. It is to be emphasized that this advantageous result is obtained in the present invention without modifying in any way the motion of the printing member itself, and in fact without any modification to the printing apparatus as a whole other than the selection of a particular contour for the cam used to impart rocking motion to the inking roll assembly.

A further important aspect of the present invention resides in the mounting arrangement for the printing member, which allows the printing member to move along separate arcuate and straight line paths during a printing cycle under the control of a single drive means. This result is obtained without introducing an undesirable level of mechanical complexity into the printing apparatus. A printing apparatus in accordance with this aspect of the invention comprises, in particular, a supporting frame, a movably mounted support means, and a printing member pivotally supported by the support means for back-and-forth pivoting movement relative to the supporting frame. The support means is movable along a substantially straight line path with respect to the supporting frame between an operative position in relative proximity to an article to be printed and a retracted position more remote from the article. A resilient biasing means is provided for normally maintaining the support means in the retracted position, and for allowing the support means to move to the operative position in response to a force sufficient to overcome the resilient biasing means.

The printing member carries a printing element, such as a printing die or a line of type, for forming printed images on the articles to be printed. The pivoting movement of the printing member is centered about an axis and occurs along an arcuate path which carries the printing element between a print-ready position in proximity to an article to be printed and a non-printing position remote from the article. The printing apparatus includes means for applying ink to the printing element during movement of the printing member between the print-ready and non-printing positions, and also includes stop means for temporarily arresting the motion of the printing member at the print-ready position.

The printing apparatus further includes drive means for cyclically moving the printing member along its arcuate path from the print-ready position to the non-printing position and then back to the print-ready position. The drive means is also effective to momentarily overcome the resilient biasing means when the arcuate motion of the printing member is temporarily arrested at the print-ready position by the stop means. This causes the support means and the printing member supported thereby to move along the substantially straight line path of the support means until the support means reaches the operative position, whereupon the printing member is moved to a printing position in which the printing element thereon is brought into contact with the surface of the article to be printed. The drive means preferably comprises a source of rotary power having an output shaft, such as an electric motor, a crank disk affixed to the output shaft, and a connecting link pivotally attached at one end thereof to a point on the crank disk and pivotally attached at the other end thereof to a point on the printing member.

By vitue of the above-described resilient mounting arrangement for the printing member, the present invention provides for movement of the printing member along separate arcuate and straight line paths under the control of a single drive means. That is, while the movable support means remains in its retracted position under the influence of the resilient biasing means, the drive means is effective to pivot the printing member in its arcuate path from the print-ready position to the non-printing position and then back to the print-ready position, with inking of the printing element taking place during this interval. When the printing member reaches the print-ready position, its motion is temporarily arrested by the stop means, and under this constraint the drive means is effective to momentarily overcome the resilient biasing means which normally maintains the movable support means in its retracted position. As the movable support means moves toward the operative position, forcing the printing member to move in the same direction, the printing member is moved to the printing position and the printing element carried thereby is brought into momentary contact with the article to be printed. Thus the back-and-forth movement of the printing member along its arcuate path past the inking means, and the subsequent straight line movement of the printing member toward the article to be printed, is all accomplished under the control of a single drive means and with a minimum of moving mechanical parts. This results in a printing apparatus of greatly simplified construction relative to the prior art, with commensurate advantages in terms of ruggedness, reliability, and ease of maintenance.

The present invention also comprehends a process for printing on the surface of an article using an inking roll and a flat printing element having a leading edge and a trailing edge. In accordance with this process, the printing element is moved along an arcuate path in proximity to the inking roll, with the arcuate path of the printing element being centered about an axis which is parallel to the plane of the printing element and which is intersected by a line drawn normal to the plane of the printing element and passing through the median line between the leading and trailing edges thereof. The leading edge of the printing element is brought into contact with the inking roll as the printing element continues to move along its arcuate path. As the line of contact between the inking roll and the printing element moves from the leading edge of the printing element to the median line between the leading and trailing edges of the printing element, this being the result of the continued movement of the printing element along its arcuate path, the inking roll is moved gradually closer to the axis which defines the arcuate motion of the printing element. With continued motion of the printing element along its arcuate path, the line of contact between the inking roll and the printing element moves from the median line of the printing element to the trailing edge of the printing element, and during this interval the inking roll is moved gradually farther away from the axis which defines the arcuate motion of the printing element. After the line of contact between the inking roll and the printing element has reached the trailing edge of the printing element, the printing member is separated from the inking roll and brought into contact with the surface of the article to be printed. The aforesaid process makes it possible to maintain running tangential contact between the inking roll and all points on the surface of the flat printing element, thereby assuring uniform inking of the printing element.

BRIEF DESCRIPTION OF THE DRAWINGS

The various objects, advantages and novel features of the invention will be more readily apprehended from the following detailed description when read in conjunction with the appended drawings, in which:

FIG. 14 is an exploded perspective view of the pivotally mounted printing member used in the printing unit of FIGS. 1–4 and supported by the assembly of FIG. 13;

FIG. 16 is an exploded perspective view of the movably mounted inking roll assembly used in the printing apparatus of FIGS. 1–4;

Throughout the drawings, like reference numerals will be understood to refer to like parts.

DETAILED DESCRIPTION OF THE PREFERRED EMBODIMENT

General Description

Figure 1:
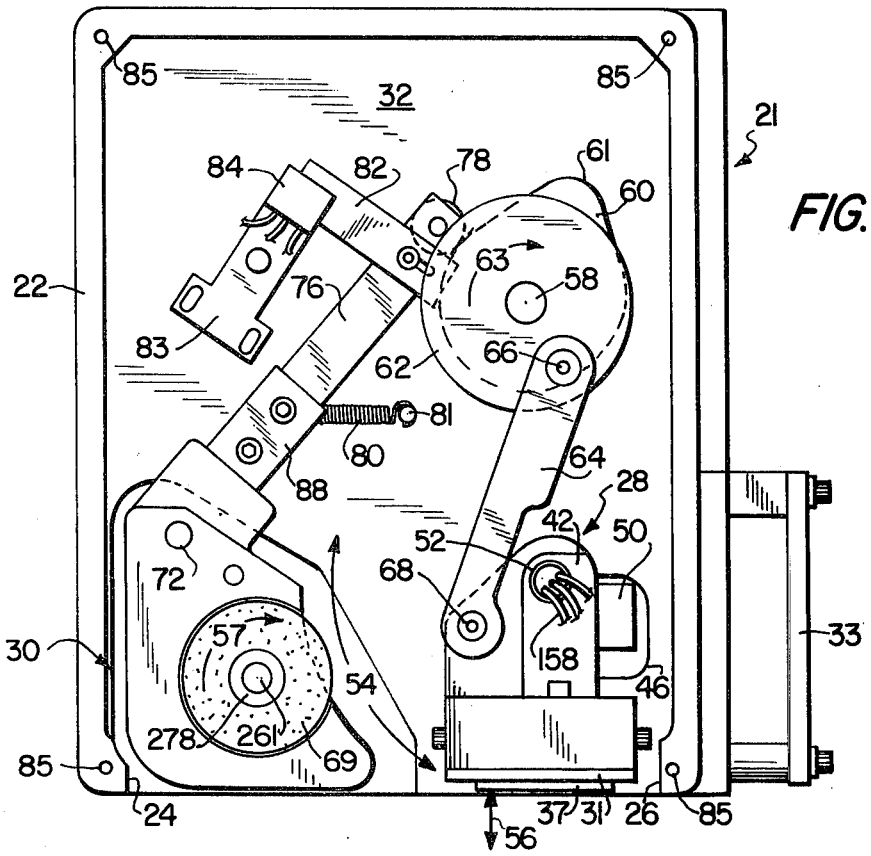
FIG. 1 is a front elevational view of an article printing unit constructed in accordance with the present invention.
Figure 2:
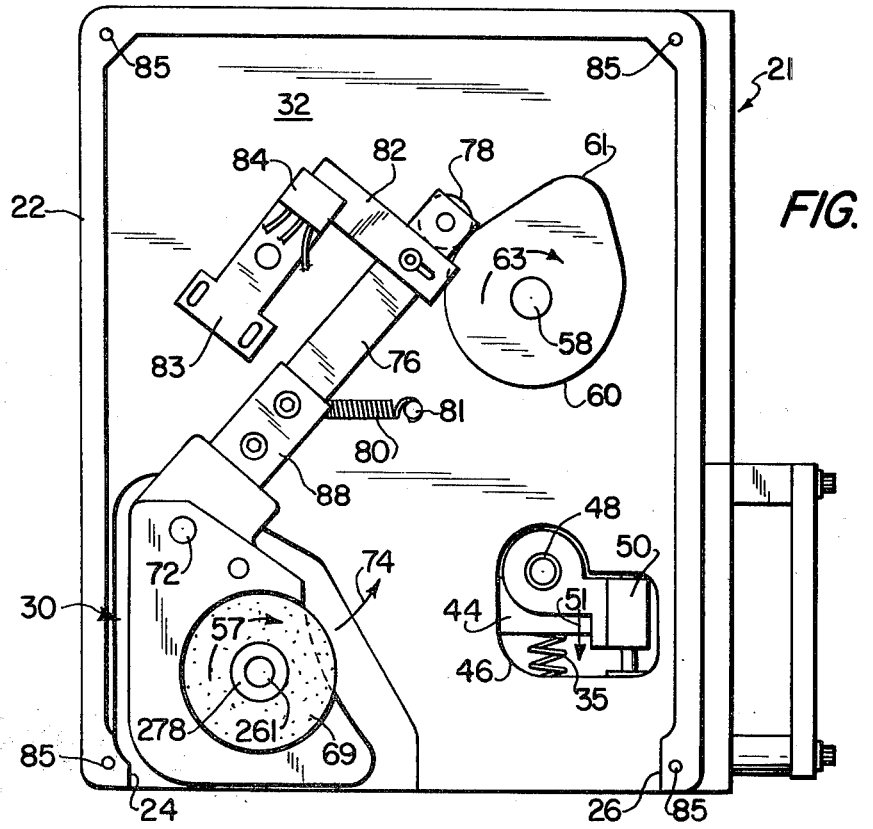
FIG. 2 is a front elevational view of the article printing unit of FIG. 1, but with certain parts removed to illustrate further details of the apparatus.
Figure 3:
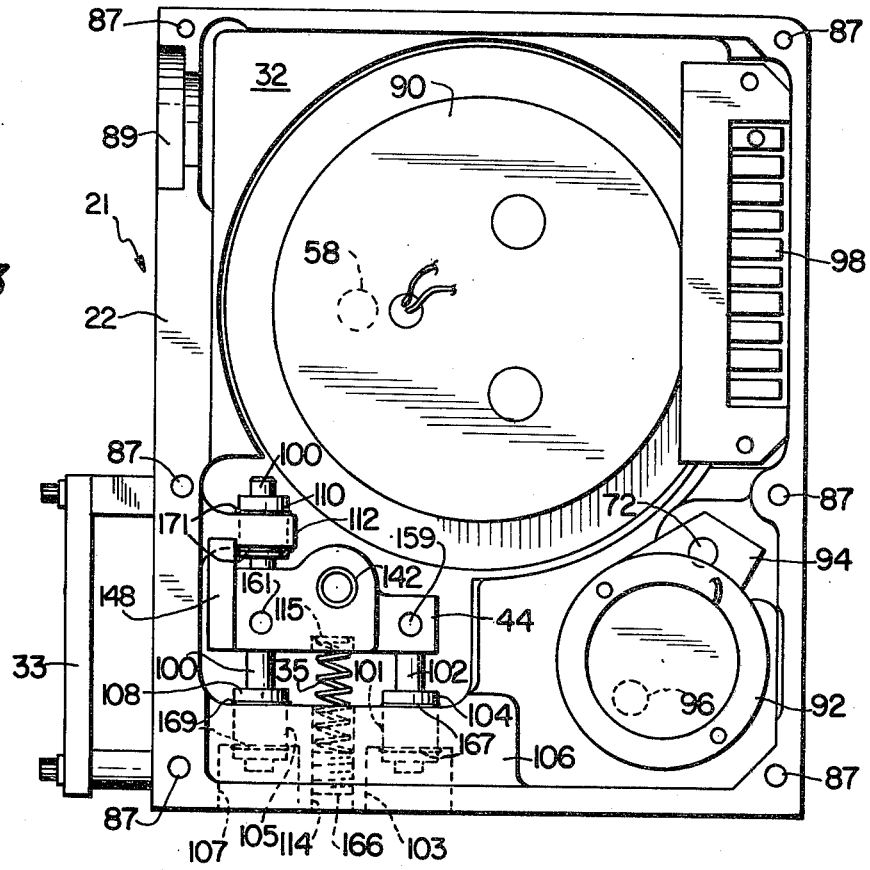
FIG. 3 is a rear elevational view of the article printing unit illustrated in FIGS. 1 and 2, with a rear cover plate removed to illustrate certain internal parts.
Figure 4:
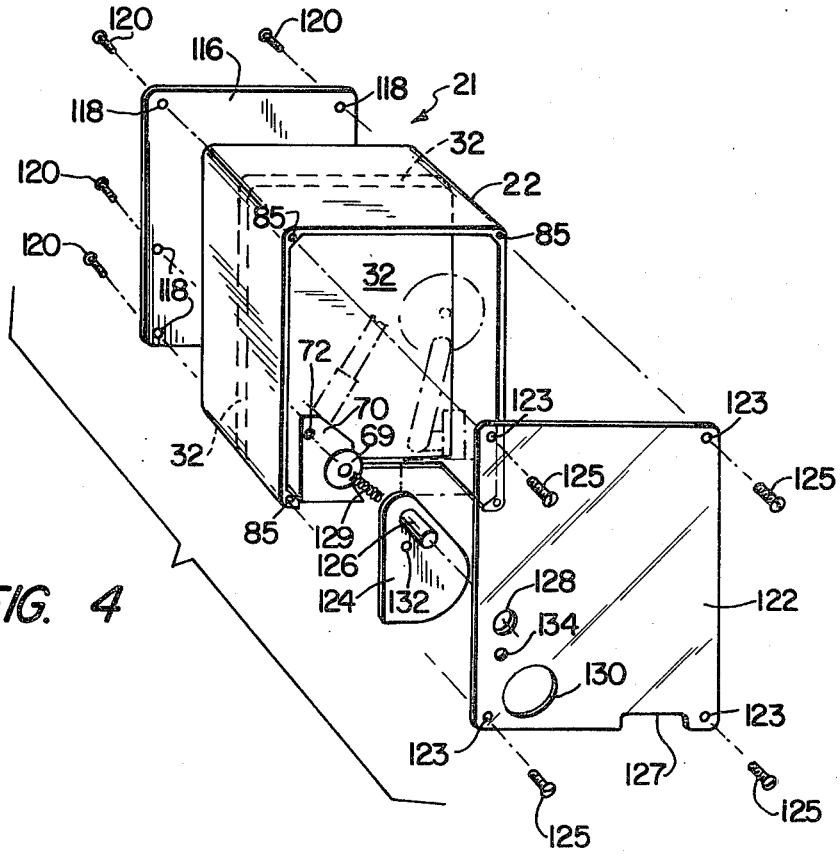
FIG. 4 is an exploded perspective view of the article printing unit illustrated in FIGS. 1–3, with protective front and rear cover plates shown.

A complete article printing unit 21 constructed in accordance with the present invention is illustrated in FIGS. 1–4. FIG. 1 is a front elevational view of the printing unit 21 with a protective front cover plate removed, illustrating the relative positions of the printing member 28, inking roll assembly 30, and the associated drive system. FIG. 2 is a similar front elevational view of the printing unit 21, except that the printing member 28 and its associated drive elements have been removed to illustrate further details of the apparatus. FIG. 3 is a rear elevational view of the printing unit 21 with a protective rear cover plate removed to illustrate the internal details of the unit. FIG. 4 is an exploded perspective view of the printing unit 21 with protective front and rear cover plates shown.

The printing unit 21 of FIGS. 1–4 includes an open rectangular housing 22, which is preferably made from cast aluminum or some other material of suitable ruggedness. A protective coating or finish is preferably applied to the housing, preferably by a black anodizing process, in order to enhance its appearance and durability and also to aid in heat dissipation. The lower front portion of the housing is partially cut away between the edges 24 and 26, as shown, in order to provide a clearance opening to accommodate the movement of the printing member 28 and inking roll assembly 30 as will be described hereinafter. The housing 22 includes an internal vertical wall 32 which is located approximately midway between the front and rear openings of the housing, as indicated in hidden lines in FIG. 4. The wall 32 is preferably made integral with the housing 22 so that both can be formed in a single casting operation. The housing 22 and wall 32 together serve as a rigid supporting frame for the various components of the printing unit 21. The printing unit 21 is constructed in a compact modular form, as shown, so that it may be conveniently positioned adjacent to an intermittently moving conveyor (not shown) for printing date codes or other identifying indicia on a continuous web or a succession of discrete articles carried by the conveyor. The housing 22 is provided with suitable mounting brackets 33 on one side thereof in order to facilitate mounting of the printing unit 21 adjacent to the product conveyor.

With particular reference now to FIGS. 1 and 2, the printing unit 21 will be seen to include a movable printing member 28 and a movable inking roll assembly 30, the latter functioning to periodically apply ink to a printing element 37 which is attached to the lower portion of the printing member 28. The printing element 37 may comprise a one-piece printing die with raised printing indicia thereon, one of several rows of loose type, one of several continuous bars of type or "word blocks" with multiple characters on each, or any other suitable type of printing device. A master plate 31 is provided for attaching the printing element 37 to the lower portion of the printing member 28. Inasmuch as the printing unit 21 is preferably used with quick-drying inks of the type which must be heated to remain in the liquid state, the lower portion of the printing member 28 includes embedded electrical resistance heating elements (not shown) for conducting heat to the printing element 37. An embedded thermistor (also not shown) is also provided in the printing member 28 for maintaining the printing element 37 at a uniform temperature.

The upper arm portion 42 of the printing member 28 is fitted with a hollow shaft 52 which is rotatably received by a bearing 48 located in the forward portion of a resiliently supported mounting block 44. The mounting block 44 is best seen in FIG. 2, in which the printing member 28 and its associated drive means have been removed for clarity. By virtue of the bearing 48, the printing member 28 is permitted to pivot relative to the mounting block 44, and hence relative to the housing 22 and vertical wall 32, with the pivot axis of the printing member 28 being coincident with the central axis of the hollow shaft 52. As a result, the printing member 28 is movable in an arcuate path between a print-ready position (shown), in which the printing member 28 and printing element 37 are in proximity to an article to be printed, and a non-printing or fully raised position (not shown), in which the printing member 28 and printing element 37 are remote from the article to be printed. The arcuate path of the printing member 28 and printing element 37 is indicated by the arrow 54 in FIG. 1. The position of the article to be printed, which is not shown in FIG. 1, is directly below the printing element 37 carried by the printing member 28. The arcuate motion of the printing member 28 carries it past the inking roll assembly 30 in a back-and-forth manner, which allows for periodic inking of the printing element 37 as will be described hereinafter. By virtue of its attachment to the printing member 28, the printing element 37 moves in an arcuate path which is centered about the axis of the hollow shaft 52. This axis is parallel to the plane of the printing element 37 and is intersected by a line drawn normal to the plane of the printing element and passing through the median line between the leading and trailing edges of the printing element.

In addition to the arcuate motion of the printing member 28, this component also undergoes a limited degree of vertical movement as a consequence of being supported by the resiliently supported mounting block 44. With reference to FIG. 2, the mounting block 44 is mounted for limited vertical movement with respect to the housing 22 and vertical wall 32 between an upper retracted position (shown) which is relatively remote from the article to be printed, and a lower operative position in relative proximity to the article to be printed. The mounting block 44 is normally maintained in the upper retracted position by means of a spring 35 or some other type of resilient biasing means located behind the wall 32. The forward portion of the mounting block 44, which carries the bearing 48 for pivotally supporting the printing member 28, protrudes through a cut-out 46 in the wall 32. When a sufficient downward force is exerted on the printing member 28 by the drive system, as will be described shortly, the upward bias on the support block 44 is overcome and the support block moves downward to the operative position. This causes the printing member 28 to move to the printing position, in which the printing element 37 is brought into contact with the surface of the article to be printed. The downward motion of the mounting block 44 is indicated by the arrow 51 in FIG. 2. When the downward force exerted by the drive system is relaxed, the mounting block 44 again moves upward to the retracted position under the influence of the spring 35, carrying the printing member 28 with it. The printing element 37, having now transferred an inked image to the article to be printed, is thereby separated from the surface of the printed article. The vertical movement of the printing member 28 and printing element 37 into and out of contact with the article to be printed is represented by the arrow 56 in FIG. 1.

The mounting block 44 includes an integral stop member 50 for arresting the pivoting motion of the printing member 28 when the latter reaches its vertical or print-ready position as shown in FIG. 1. The stop member 50 is in the form of a projecting abutment on the mounting block 44 which extends into the arcuate path of the printing member 28. The vertical movement of the mounting block 44 between its retracted and operative positions takes place while the printing member is inhibited from further arcuate motion by the stop member 50.

With reference to FIG. 1, the drive means for the printing member 28 includes a motor-driven output shaft 58 which is attached to a cam 60 for controlling the movement of the inking roll assembly 30 in a manner to be described shortly. The output shaft 58 is also affixed to a crank disk 62 which overlies the cam 60 with a small spacing therebetween. A connecting link 64 is pivotally connected at one end thereof to a point near the periphery of the crank disk 62 by means of a radial ball bearing 66 or other type of pivotal connection. The opposite end of the connecting link 64 is pivotally connected to the upper arm portion 42 of the printing member 28 by means of a similar bearing 68. The bearing 68 is offset from the axis of the hollow shaft 52, the latter constituting the pivot axis of the printing member 28, in the direction of the ink roll assembly 30. When the shaft 58 is rotated in the clockwise direction by an electric motor or other rotary power source, as indicated by the arrow 63, the cam 60 and crank disk 62 will rotate in unison. Rotation of the crank disk 62 will cause the connecting link 64 to move in a reciprocating manner, alternately exerting upward and downward components of force on the printing member 28 through the bearing 68. Since the bearing 68 is offset from the pivot axis of the printing member 28 in the direction of the inking roll assembly 30, these alternating upward and downward forces will for the most part cause the printing member 28 to pivot in a back-and-forth manner, first clockwise and then counter-clockwise, along the arcuate path indicated by the arrow 54 in FIG. 1. This path of movement carries the printing element 37 past the inking roll assembly 30 to achieve the desired inking of the printing element during the printing cycle.

When the crank disk 62 and connecting link 64 reach the particular positions shown in FIG. 1, the connecting link is exerting a downward component of force on the bearing 68 tending to rotate the printing member 28 further in the counter-clockwise direction. However, further arcuate motion of the printing member in this direction is prevented by the stop member 50 which projects from the mounting block 44. As a result, the printing member 28 and mounting block 44 are forced downwardly by the connecting link 64 against the resistance of the spring 35. This brings the printing element 37 into contact with the surface of the article to be printed. Further clockwise rotation of the crank disk 62 will cause the connecting link 64 to move upward, allowing the mounting block 44 to return to its upper retracted position due to the upward force exerted by the spring 35. This causes the printing element 37 to be withdrawn from contact with the printed article.

In practice, it is preferred to have the printing cycle begin when the components of the printing unit 21 are in the positions illustrated in FIG. 1. That is, when an article to be printed moves into position below the printing member 28 and the printing unit 21 is started, the first movement of the printing member 28 will be vertically downward from the print-ready position of FIG. 1 to the printing position. In the latter position, the printing element 37 is brought into contact with the article surface, and transfers an inked image to the article with ink received from the inking roll assembly 30 during the previous cycle. As the crank disc 62 moves further in the clockwise direction, the printing member 28 moves upward to the print-ready position and is then moved back and forth past the inking roll assembly 30 along the arcuate path 54 as described previously. During this interval ink is applied to the printing element 37 by the inking roll assembly 30 in preparation for the next printing cycle. Shortly before the printing member 28 again reaches the vertical or print-ready position of FIG. 1, power is removed from the shaft 58, although due to inertia the printing member 28 continues to coast toward the print-ready position. When the printing member 28 finally reaches the vertical or print-ready position as shown in FIG. 1, where it is restrained from further movement by the stop member 50, the printing cycle is complete. When the next article moves into place below the printing member 28, the drive means is restarted and the printing cycle is repeated.

Referring now to FIG. 2, the inking roll assembly 30 will be seen to comprise a rotatable inking roll 69 and a housing 70 for supporting and partially enclosing the inking roll. An electric motor (not shown) mounted behind the wall 32 imparts continuous rotation to the inking roll 69 in the clockwise direction, as indicated by the arrow 57. The inking roll 69 may be of any suitable type, but in the preferred embodiment comprises a cylindrical body of porous plastic foam which is impregnated with an ink composition. Preferably, the ink composition is of the type which is solid at room temperature, and which can be rendered liquid and flowable when subjected to a sufficient amount of heat. Inking rolls impregnated with an ink composition of this type are available from the assignee, Markem Corporation, of Keene, New Hampshire, as Part No. 8000300. Internal electrical heating means (not shown) are provided within the housing 70 in order to render the ink carried by the ink roll 69 sufficiently flowable for transfer to the printing element 37. A thermistor (not shown) is also included in the housing 70 of the inking roll assembly in order to maintain a uniform temperature. As already noted, the printing member 28 includes similar embedded heating means for maintaining the printing element 37 at an elevated temperature, which serves to maintain the ink transferred from the inking roll 69 in a liquid state until it is applied to the surface of the article or web to be printed. The ink quickly cools and dries after it is applied to the article or web surface, which makes it possible to handle the printed surface almost immediately without the danger of smearing the printed image.

The inking roll assembly 30 is movably mounted with respect to the housing 22 and vertical wall 32 of the printing unit 21. The purpose of this arrangement is to assure that ink is applied to the printing element 37 only once during each full cycle of movement of the printing member 28, that is, during the interval when the printing member 28 is moving in the same direction as the periphery of the rotating inking roll 69. The movement of the inking roll assembly 30 is in the form of back-and-forth rocking movement about a pivot shaft 72 which passes through the vertical wall 32 of the printing unit, with the inking roll 69 and housing 70 moving as a unit. The path of movement of the inking roll 69, which is indicated by the arrow 74 in FIG. 2, consists of a small arc centered about the pivot shaft 72 and intersecting the path of movement 54 of the printing element 37. In the inoperative or retracted position of the inking roll assembly 30, which is the position illustrated in FIGS. 1 and 2, the periphery of the inking roll 69 is maintained out of contact with the printing element 37 as the printing member 28 moves along the arcuate path 54 between the print-ready and non-printing positions. When the inking roll assembly 30 moves to the operative position in the direction of the arrow 74, the periphery of the inking roll 69 is in a position to make rolling contact with the printing element 37 as the printing member 28 moves between the print-ready and non-printing positions. In this way, the printing element 37 is inked only once during a full cycle of motion of the printing member 28. In the preferred embodiment of the invention, the rocking movement of the inking roll assembly 30 is such that the inking roll 69 is maintained out of contact with the printing element 37 during the initial clockwise movement of the printing member 28 from the print-ready position to the non-printing position, and is brought into rolling contact with the printing element 37 during the return counter-clockwise movement of the printing member 28 from the non-printing position to the print-ready position. It is during the latter interval that the printing element 37 is moving in the same direction as the periphery of the inking roll 69, and hence it is during this interval that smooth rolling contact can be established between these components in order to assure a uniform application of ink to the printing element. However, in cases where the inking roll 69 is rotated in the opposite direction or is mounted for free rotation in either direction, it is equally within the scope of the invention to control the rocking movement of the inking roll assembly 30 so that ink is applied to the printing element 37 during the initial movement of the printing member 28 from the print-ready position to the non-printing position, with the inking roll assembly then being maintained in the retracted or inoperative position of FIGS. 1 and 2 while the printing member executes the return movement from the non-printing position to the print-ready position.

The rocking movement of the inking roll assembly 30 between the retracted and operative positions is controlled by the cam 60, which, as already noted, is affixed to the motor shaft 58 that is used for driving the printing member 28. A follower arm 76 is affixed to the housing 70 of the inking roll assembly 30 at a point near the pivot shaft 72 by means of a tie bar 88. The opposite end of the follower arm 76 carries a cam follower 78, which preferably comprises a radial ball bearing unit, for contacting the contoured or profiled surface of the cam 60. A tension spring 80 is connected between an intermediate point on the follower arm 76 and a pin 81 which is press-fitted into the vertical wall 32 of the printing unit 21 in order to urge the cam follower 78 into contact with the cam 60. As the cam 60 rotates, the follower arm 76 will be displaced outwardly and inwardly with respect to the shaft 58 in accordance with the radius of the cam at the point of contact with the cam follower 78. Displacement of the follower arm 76 will cause the housing 70, and hence the inking roll 69, to rock or pivot in a cyclical manner about the pivot shaft 72. The rocking motion of the inking roll assembly 30, which occurs in the direction of the arrow 74, causes the periphery of the inking roll 69 to move alternately into and out of the path of the printing element 37 as the printing member 28 moves back and forth between the print-ready and non-printing positions. By appropriate selection of the contour of the cam 60, contact between the inking roll 69 and the printing element 37 can be made to occur either during the initial movement of the printing member 28 from the print-ready position to the non-printing or fully raised position, or alternatively during the return movement of the printing member 28 from the non-printing position to the print-ready position. As already noted, in view of the direction of rotation of the inking roll 69 in FIGS. 1 and 2, it is preferable that such contact occur during the return movement of the printing member 28 toward the print-ready position. To this end, the lobe 61 or point of greatest radius on the cam 60 is located at a particular angular position relative to the pivot bearing 66 to insure that the periphery of the inking roll 69 is moved into the path of the printing element 37 at the proper moment during the return movement of the printing member 28 from the non-printing position to the print-ready position. In practice, the contour of the cam 60 is chosen so that, in addition to simply moving the inking roll 69 into the path of the printing element 37 at the appropriate point during the printing cycle, the cam continues to cause movement of the inking roll 69 in a manner insuring that running tangential contact is maintained between the inking roll and the entire surface of the flat printing element 37. This function of the cam 60 will be described in some detail hereinafter.

For control purposes, the follower arm 76 is fitted with a metallic vane 82 which is arranged to align with a Hall effect switch 84 at a certain point near the end of the printing cycle Such alignment causes the Hall effect switch 84 to produce a signal which removes power from the drive shaft 58, although the printing member 28 continues to coast toward the print-ready position of FIG. 1 until it strikes the stop member 50. In practice, full alignment between the vane 82 and Hall switch 84 commences shortly before the cam follower contacts the point 61 of greatest radius on the cam 60. This is followed by an interval during which the cam 60 and crank disk 62 coast through an angle of about 90° as the printing member continues to move toward the print-ready position. At that point, the printing cycle is complete. Subsequent restarting of the printing unit 21 occurs in response to a separate signal produced externally by the article conveyor system, indicating that another article or web location has moved into position below the printing member 28. The Hall effect switch 84 is preferably a No. 1AV3A vane-operated switch manufactured by Microswitch, a division of Honeywell Inc., Freeport, Ill. A mounting plate 83 is used to secure the Hall effect switch 84 to the vertical wall 32 of the printing unit 21. A more detailed description of the electrical control system for the printing unit 21 will be given hereinafter in connection with FIGS. 23–25.

With reference now to FIG. 3, the back of the printing unit 21 is shown with the rear cover plate removed in order to illustrate the internal components of the unit. Visible in this view are the D.C. drive motor 90 for the printing member 28, a smaller A.C. motor 92 for imparting continuous rotation to the inking roll 69, and the resiliently supported mounting block 44 for supporting the printing member 28. The printing member drive motor 90 is preferably a Model U9FG 12-volt D.C. motor available from PMI Motors, division of Kollmorgen Corp., Syosset, New York. The motor 90 contains an internal 15:1 gear reduction unit which drives the output shaft 58. The shaft 58 is offset from the axis of the motor housing and protrudes through a hole (not shown) formed in the vertical wall 32 of the printing unit 21 to enable it to be coupled to the cam 60 and crank disk 62 of FIG. 1. The motor 90 is rigidly mounted to the vertical wall 32 of the printing unit 21 by means of screws or other suitable fastening means.

The inking roll motor 92 is mounted on a movable motor plate 94 which is affixed to the interior end of the ink reservoir pivot shaft 72. The pivot shaft 72 is rotatably mounted through a cylindrical boss (not shown) formed in the vertical wall 32 of the printing unit by means of a pair of ball bearing units as will be described in more detail below. The shaft 96 of the motor 92 protrudes through a hole in the lower part of the motor plate 94 and is coupled to the shaft which carries the inking roll 69 of FIGS. 1 and 2 in order to impart continuous rotation to the inking roll when the printing unit 21 is in operation. Due to the mounting of the inking roll motor 92 on the movable plate 94, the motor 92 is free to move as a unit with the inking roll assembly 30 of FIGS. 1 and 2 when the latter is rocked under the control of the cam 60 and follower arm 76. The inking roll motor 92 is preferably a Model 447 120-volt, 120 RPM A.C. motor available from Bristol Saybrook Co. of Old Saybrook, Conn.

An electrical terminal block 98 is mounted within the housing 22 above the inking roll motor 92 in order to provide termination points for the electrical connections to the electrical resistance heaters and thermistors embedded in the printing member 28 and the housing 70 of the inking roll assembly 30, as well as certain ground connections. The wires connecting these components to the terminal block 98 have been omitted from FIG. 3 for clarity. A hole 89 is provided in the side of the housing 22 of the printing unit 21 in order to accommodate a strain relief device (not shown) for the wires leading to the interior of the housing 21.

With further reference to FIG. 3, the resiliently supported mounting block 44 for the printing member 28 will be seen to include two rigidly attached vertical slide rods 100 and 102. The slide rod 102 extends downwardly from the mounting block 44 and is slidably received within a linear ball bushing 104. The ball bushing 104 is rigidly mounted in a lower boss 106 which is integral with the housing 22. A hole 101 is formed in the top surface of the lower boss 106 and extends downwardly to communicate with a somewhat larger access hole 103 formed through the bottom of the printing unit housing 22. The ball bushing 104 is secured within the hole 101 by a pair of snap rings 167, with the lower snap ring being inserted through the hole 103. The slide rod 100 extends both upwardly and downwardly from the mounting block 44, and has its lower end slidably received in a second linear ball bushing 108. The ball bushing 108 is secured by snap rings 169 within a hole 105 formed in the upper portion of the boss 106. The hole 105 communicates with a somewhat larger access hole 107, similar to the hole 103, formed through the bottom of the printing unit housing 22. Snap rings 169 hold the ball bushing 108 in place. The upper end of the slide rod 100 is slidably received in a third linear ball bushing 110 which is mounted in an upper boss 112 located above the shelf 106. The upper boss 112 is also formed integrally with the housing 22 of the printing unit 21. The upper boss 112 contains a through-hole 113 in which the ball bushing 110 is secured by means of a pair of snap rings 171. The ball bushings 104, 108 and 110 are preferably. No. A-4812 linear-motion ball bushings which are available from Thomson Industries, Inc., of Manhasset, New York.

With continued reference to FIG. 3, the coil spring 35 is seated in a circular hole 114 formed in the lower boss 106 and is maintained in compression between the bottom of the hole 114 and the underside of the mounting block 44. A shallow hole 115 is formed in the bottom surface of the mounting block 44 in order to receive the top end of the spring 35. The spring 35 thus serves to exert a resilient biasing force on the mounting block 44 in the upward direction. The hole 114 is tapped in order to receive a set screw 166, the latter serving as the bottom of the hole 114 and hence the bottom support for the spring 35. Movement of the set screw 166 upward or downward in the hole 114 allows adjustment of the upward biasing or preload force exerted by the spring 35. By virtue of the slidable relationship between the rods 100 and 102 and the ball bushings 104, 108 and 110, the mounting block 44 is free to move vertically between the upper and lower supporting bosses 106 and 112 in response to forces exerted on the printing member 28 by the crank disk 62 and connecting arm 64 of FIG. 1. Due to the upward biasing force exerted by the coil spring 35, the mounting block 44 is normally maintained in the upper retracted position as shown in FIG. 3 until a sufficient downward force is exerted on the printing member 28 by the drive system.

Referring momentarily to FIGS. 1 and 2, it will be noted that tapped holes 85 are formed at the front corners of the housing 22 of the printing unit 21. With reference to FIG. 3, similar tapped holes 87 are formed on the rear edges of the housing 22. These holes permit protective front and rear cover plates to be attached to the printing unit 21 as will now be described in connection with FIG. 4. The rear cover plate 116 comprises a rigid sheet of black anodized aluminum or other suitable material with a number of holes 118 at the edges thereof corresponding to the holes 87 in the rear part of the housing 22. Screws 120 or other suitable fasteners are used to attach the rear cover plate 116 to the holes 87 in the back of the housing 22. The front cover plate 122 preferably comprises a sheet of rigid transparent or tinted plastic material, such as Lexan (polycarbonate) or plexiglass, which will permit the forward components of the printing unit 21 to be visually observed while the unit is in operation. Holes 123 are formed in the forward cover plate 122 at locations corresponding to the tapped holes 85 at the front corners of the printing unit housing 22. Screws 125 or other suitable fasteners are inserted through the holes 123 and engaged with the tapped holes 85 to secure the front cover plate 122 to the front portion of the housing 22. A shallow rectangular cutout 127 is formed along the lower edge of the front cover plate 122 in a position corresponding to the lower portion of the printing member 28 in FIG. 1. This facilitates removal and replacement of the master plate 31 and printing element 37 without the necessity of removing the front cover plate 122.

In addition to the front cover plate 122, a separate inking roll cover 124 is provided for permitting the inking roll 69 to be removed and replaced without removing the front cover plate 122. The inking roll cover 124 is preferably made of a suitable heat-resistant plastic material, such as Valox, with an oblong shape generally conforming to the shape of the front portion of the housing 70 of the inking roll assembly 30. The inking roll cover 124 is formed with an integral knob 126 which projects loosely through a corresponding hole 128 in the front cover plate 122. The knob 126 has a hollow interior which opens onto the rear surface of the inking roll cover 124. A coil spring 129 is bonded to the interior of the knob 126 and protrudes through the rear opening of the knob in the direction of the housing 70 of the inking roll assembly. In the fully assembled condition of the printing unit 21, the inking roll cover 124 is nested between the front cover plate 122 and the front surface of the housing 70 in the position shown, thereby covering the exposed end of the inking roll 69. The exposed end of the coil spring 129 is compressed against the front surface of the housing 70 and fits over the protruding end of the pivot shaft 72. The spring 129 serves to maintain the inking roll cover 124 in position against the rear face of the front cover plate 122. When it is desired to replace the inking roll 69, the protruding end of the knob 126 is rotated approximately 90° in the counterclockwise direction, which exposes the end of the inking roll 69 to a corresponding hole 130 formed in the front cover plate 122. The hole 130 is slightly larger in diameter than the inking roll 69 in order to allow convenient removal thereof and insertion of a new inking roll.

Preferably, a small raised boss 132 is formed on the front surface of the inking roll cover 124 in a position aligned with a correspondingly sized hole 134 formed in the front cover plate 122 below the hole 128. The compression force exerted by the spring 129 normally causes the boss 132 to remain seated within the hole 134. This provides a detent function which normally maintains the inking roll cover 124 in the closed position. In order to move the inking roll cover 124 to the open position, the knob 126 is first pushed slightly inward against the resilient force exerted by the spring 129, which serves to unseat the boss 132 from the hole 134. The knob 126 can then be turned 90° in the counterclockwise direction as described previously to allow replacement of the inking roll 69 through the hole 130.

OPERATION

Before proceeding with a detailed description of the individual components and subassemblies of the printing unit 21, it will be helpful to describe the coordinated sequence of movements of the printing member 28 and the inking roll assembly 30 which constitutes a complete printing cycle. This description will be given with reference to FIGS. 5–12, which are diagrammatic illustrations of the positions of the printing member 28 and the inking roll assembly 30 at several different points during the printing cycle.

Figure 5:
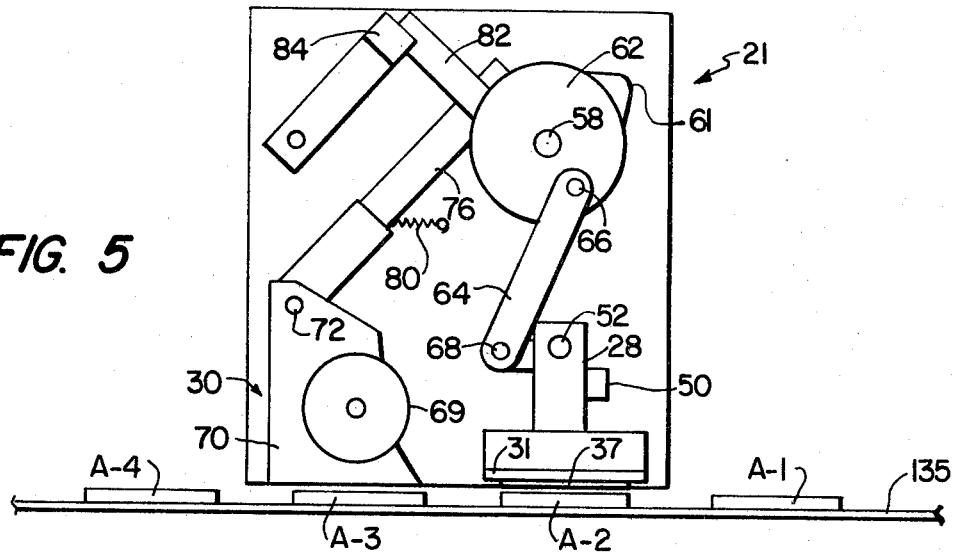
FIGS. 5–12 are sequential diagrammatic views of the printing unit of FIGS. 1–4, illustrating the relative positions of the printing member and inking roll assembly during a complete cycle of operation.

Referring first to FIG. 5, the printing unit 21 is shown positioned above an article conveyor 135. The conveyor 135, which is not itself a part of the present invention, is arranged to move in an intermittent manner and carries a succession of articles A-1 through A-4 to be printed. It should be emphasized that the present invention is equally applicable to the printing of continuous webs, and in that case the locations of the articles A-1 through A-4 on the conveyor 135 would correspond to blank web locations in which printed indicia are to be formed.

For the purpose of illustration, it will be assumed that the article A-1 has already been printed and the next article A-2 has moved into position below the printing element 37 carried by the printing member 28. At this point the conveyor 135 stops, and a signal from the conveyor system starts the printing unit 21, which causes the motor shaft 58 to begin turning in the clockwise direction. At this moment the printing member 28 is in the vertical or print-ready position of FIG. 1, and the mounting block 44 of FIG. 3 is in its raised or retracted position. Hence the printing element 37 is maintained in a raised or non-contacting position relative to the surface of the article A-2. The inking roll assembly 30 is also in its retracted or inoperative position as shown.

As the shaft 58 begins to rotate, the crank disk 62 causes the connecting link 64 to move downward, due to the fact that the pivot bearing 66 has not yet rotated to its lowermost position relative to the motor shaft 58. As a result, a downward force is exerted on the pivot bearing 68 which connects the link 64 to the printing member 28. Due to the offset between the pivot bearing 68 and the hollow pivot shaft 52 of the printing member 28, this downward force would tend to rotate the printing member 28 in a counter-clockwise direction in the absence of the stop member 50. However, since the right-hand side of the printing member 28 is now in abutting contact with the stop member 50, further pivoting of the printing member 28 in the counter-clockwise direction is prevented and thus the printing member is temporarily arrested at the printing position. As a consequence, the downward component of force exerted on the printing member 28 by the connecting link 64 acts to move the mounting block 44 of FIG. 3 downwardly, overcoming the upward biasing force exerted by the spring 35. This causes the mounting block 44 and printing member 28 to begin moving downwardly along the straight-line path defined by the slide rods 100 and 102.

Figure 6:
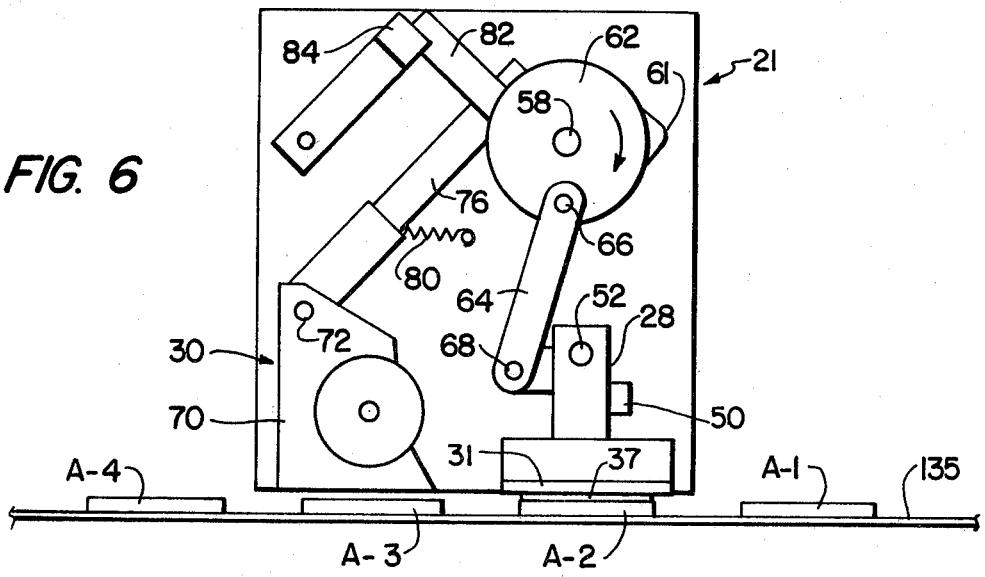

Further rotation of the motor shaft 58 and crank disk 62 will cause the pivot bearing 68 to move to its lowermost position relative to the shaft 58 as shown in FIG. 6. This causes the mounting block 44 of FIG. 3 to move completely to its lower or operative position, which moves the printing member 28 downwardly by an equal distance. This brings the printing element 37, which carries ink applied by the inking roll 69 during the previous print cycle, into printing contact with the upper surface of the article A-2.

Figure 7:
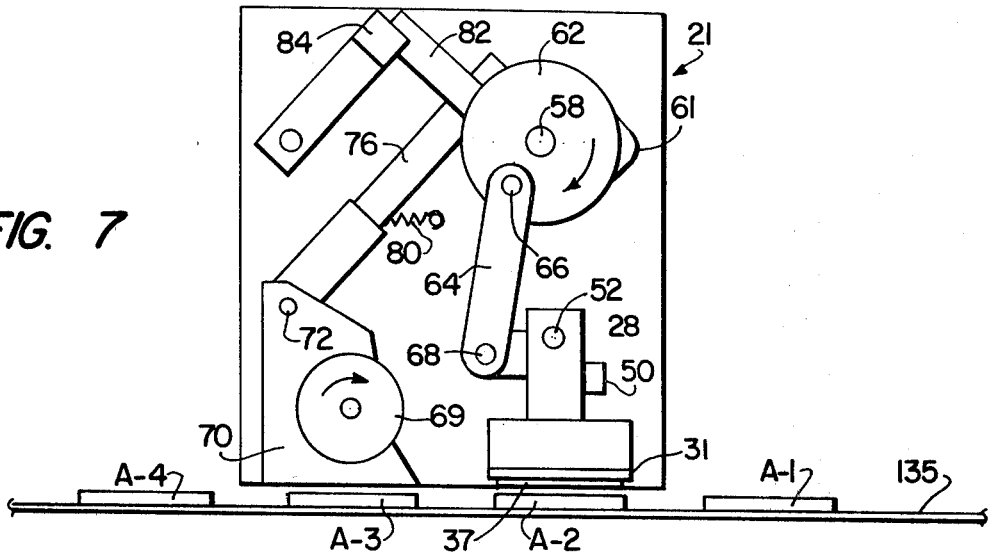

Continued rotation of the motor shaft 58 and crank disk 62 now causes the pivot bearing 66 and connecting link 64 to move in an upward direction, thereby relaxing the downward force on the printing member 28 and mounting block 44. The spring 35 of FIG. 3 is then effective to restore the mounting block 44 to its upper retracted position, which causes the printing member 28 to move upwardly and the printing element to separate from the surface of the article A-2 as shown in FIG. 7. At this point the article A-2 has been printed and the conveyor 135 can be restarted if desired. However, since the conveyor 135 is operated independently of the printing unit 21, with the exception of the start signal referred to previously, the time of restarting of the conveyor is not critical and for the purpose of illustration has been delayed to a later point during the printing cycle.

In practice, the vertical distance traveled by the mounting block 44 of FIG. 3, and hence by the printing element 37, need not be very large. A travel distance of about 0.25 inch between the upper and lower positions of the mounting block 44 has been found to be sufficient in most cases. This provides adequate clearance between the printing element 37 and the surfaces of the articles to allow for movement of the articles by the conveyor 135 after printing, and also allows sufficient clearance between the articles and the edges of the printing element 37 during pivoting of the printing member 28 as will now be described in connection with FIGS. 8–12.

Figure 8:
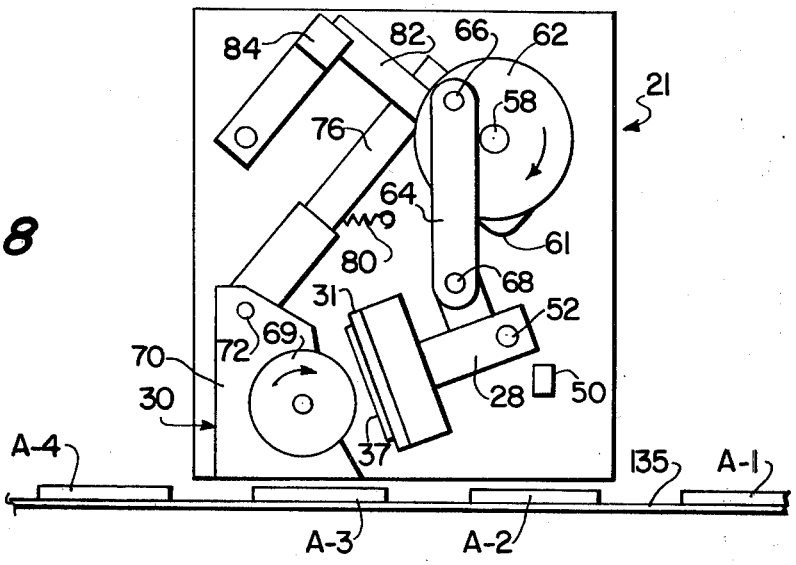

As the shaft 58 continues to rotate, the crank disk 62 causes the connecting link 64 to continue moving upward. Since the mounting block 44 of FIG. 3 is now in its fully raised or retracted position, the connecting link begins to exert an upward force on the pivot bearing 68 connecting the link 64 to the printing member 28. Due to the offset between the pivot bearing 68 and the hollow pivot shaft 52, the printing member leaves the print-ready position and begins to pivot in a clockwise direction as shown in FIG. 8. The clockwise pivoting of the printing member 28 carries the attached printing element 37 in an arcuate path past the inking roll assembly 30, although there is no contact between the printing element 37 and the inking roll 69 at this time inasmuch as the inking roll assembly 30 is still in its inoperative or retracted position.

Figure 9:
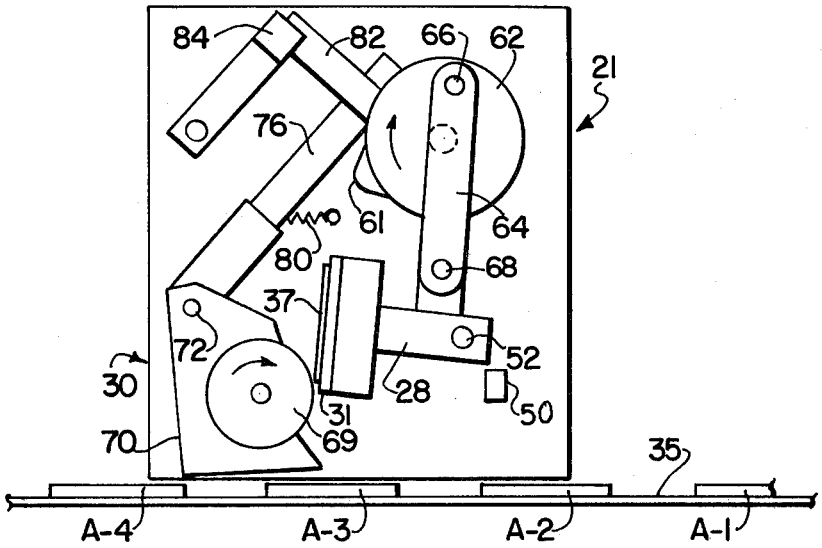

Further rotation of the shaft 58 causes the printing member 28 to reach the fully raised or non-printing position as shown in FIG. 9. At this point no further clockwise pivoting of the printing member 28 is possible, due to the fact that the pivot bearing 66 which forms the attachment between the crank disk 62 and the connecting link 64 has reached its uppermost position. The cam lobe 61 is now approaching, but has not yet reached, the cam follower positioned at the upper end of the follower arm 76. However, the rising part of the cam 60 in advance of the lobe 61 is now in contact with the cam follower on the end of the follower arm 76, causing the follower arm to be displaced slightly in a direction away from the motor shaft 58. This has the effect of slightly rocking the housing 70 of the inking roll assembly 30 about the pivot shaft 72 in a counter-clockwise direction, although the periphery of the inking roll 69 has not yet moved to a position intersecting the arcuate path of the printing element 37. Movement of the follower arm 76 also has the effect of causing the metallic vane 82 to move toward a position of alignment with the Hall effect switch 84, although the position of the vane in FIG. 9 is not yet effective to produce a leading-edge signal from the Hall effect switch 84. In practice, this signal occurs shortly after the cam 60 reaches the position shown in FIG. 9, but before the cam 60 reaches the position shown in FIG. 10.

Figure 10:
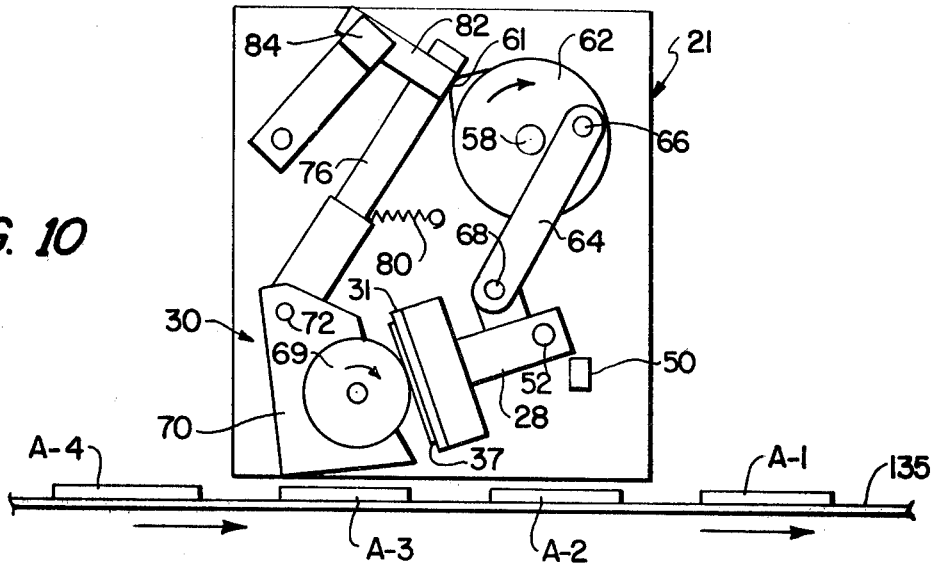

With continued rotation of the shaft 58 and crank disk 62, the connecting link 64 begins to move downwardly, causing the printing member to begin to pivot in a counter-clockwise direction away from the non-printing position as shown in FIG. 10. Simultaneously, the cam lobe 61 engages the cam follower mounted on the upper end of the follower cam 76, causing the follower arm to be displaced further in the direction away from the motor shaft 58. This has the effect of rocking the housing 70 of the inking roll assembly 30 farther about the pivot shaft 72 in a shot counter-clockwise arc, which in turn causes the periphery of the inking roll 69 to move to a position intersecting the arcuate path of the printing element 37. Rolling contact is therefore established between the bottom surface of the printing element 37 and the periphery of the inking roll 69, allowing ink to be applied to the printing element 37. As will be described in detail hereinafter, the contour of the cam lobe 61 is preferably chosen so that, during the interval of contact between the inking roll 69 and the printing element 37, the inking roll 69 continues to move in a gradual manner, first inwardly toward the shaft 52 and then in the opposite direction, as the line of contact between the inking roll 69 and the printing element 37 progresses from the leading edge of the printing element to the trailing edge of the printing element. This has the effect of maintaining a consistent degree of tangential contact between the inking roll 69 and the entire face of the printing element 37, and thus assures that the printing element is inked in a uniform manner.

With further reference to FIG. 10, the metallic vane 82 is now positioned farther into the Hall effect switch 84 than it was in FIG. 9. However, as noted above, the position of effective alignment between the vane 82 and Hall effect switch 84 has already occurred, and hence the leading edge of the signal from the Hall effect switch 84 has already been produced. As will be described in more detail hereinafter in connection with the electrical schematic diagrams of FIG. 23, the leading edge of the signal from the Hall effect switch 84 causes power to be removed from the printing member drive motor 90 of FIG. 3 and thus functions as a stop signal. However, due to the inertia of the motor 90 and the inertia associated with the various moving parts of the printing unit 21, the motor shaft 58 and crank disk 62 continue to coast. This allows the printing member 28 and the inking roll assembly 30 to continue to move during the remaining portion of the printing cycle represented by FIGS. 10–12.

For purposes of illustration, the conveyor 135 is shown to be set in motion at the point in the printing cycle represented by FIG. 10. However, it is to be emphasized that, with the exception of the start signal from the conveyor system that initiates the printing cycle, the movement of the conveyor 135 is entirely independent of the operation of the printing unit 21. In other words, the restarting of the conveyor may occur at any point during the printing cycle after the printing element 37 separates from the printed article, as represented in FIG. 7, or it may occur at some point after the entire printing cycle of FIGS. 5–12 is completed. The sole constraint on the motion of the conveyor system is that the conveyor 135 remain stopped long enough to allow printing to occur during the interval represented by FIGS. 5–7.

Figure 11:
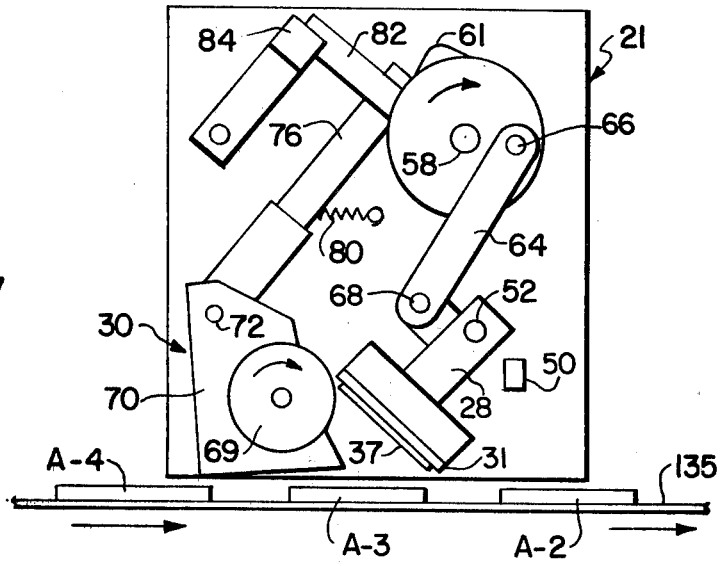

Continued coasting of the motor shaft 58 and crank disk 62 will cause the printing member 28 and inking roll assembly 30 to move to the positions shown in FIG. 11. At this point the connecting link 64 is moving downward, and the printing member is continuing to pivot in the counter-clockwise direction toward the print-ready position. The printing element 37 has now been completely inked and has separated from the inking roll 69. In addition, since the cam lobe 61 has rotated to a position beyond the upper end of the follower arm 76, the inking roll assembly 30 has begun to return to its inoperative or retracted position and the vane 82 has been withdrawn from alignment with the Hall effect switch 84. It should be noted that, inasmuch as counter-clockwise pivoting of the printing member 28 about the axis of the hollow shaft 52 is still possible at this point, the connecting link 64 is not exerting a sufficient downward force on the resiliently supported mounting block 44, shown in FIGS. 2 and 3, to overcome the upward biasing force of the spring 35. Therefore, throughout the interval represented by FIGS. 7–11, the mounting block 44 has remained in its raised or retracted position as illustrated in FIGS. 2 and 3. It should be noted that the conveyor 135, which for purposes of illustration was restarted at the point during the printing cycle represented by FIG. 10, has now begun to move the next article A-3 into position below the print-ready position of the printing member 28.

Figure 12:
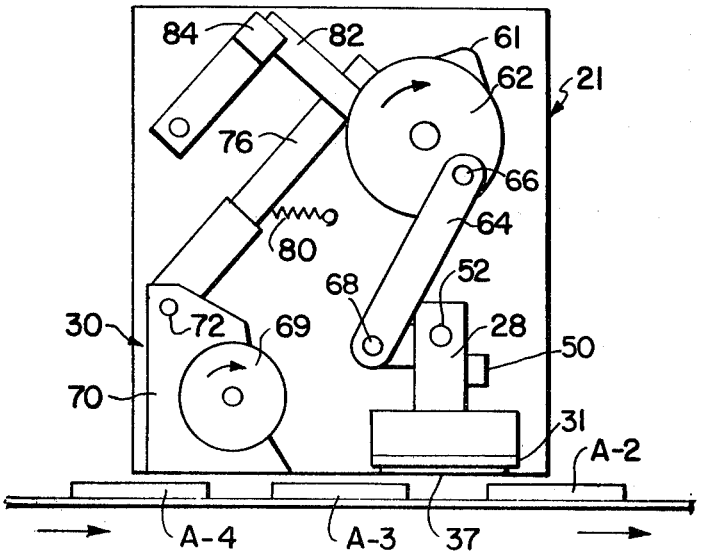

In FIG. 12, the crank disk 62 has coasted sufficiently to advance the printing member 28 to the vertical or print-ready position. In this position the right-hand side of the printing member 28 is in abutting contact with the stop member 50, which prevents any further arcuate movement of the printing member in the counter-clockwise direction and thus temporarily arrests the motion of the printing member at the print-ready position. Further coasting of the crank disk 62, which would tend to move the pivot bearing 66 and connecting link 64 in a downward direction, is resisted by the upward biasing force exerted by the spring 35 on the mounting block 44 of FIG. 3. In practice, the position of the metallic vane 82 relative to the follower arm 76 can be adjusted so that the amount of coasting of the crank disk 62 subsequent to the leading edge of the stop signal produced by the Hall effect switch 84 is just sufficient to bring the printing member into contact with the stop member 50.

Thus when the crank disk 62, connecting link 64 and printing member 28 reach the positions illustrated in FIG. 12, all movement of these components stops and the printing cycle is complete. It should be noted that, since the cam follower on the upper end of the follower arm 76 is now completely past the area of cam rise adjacent to the cam lobe 61, the inking roll assembly 30 has been fully restored to its retracted or inoperative position. The printing element 37, having received ink from the inking roll 69 near the end of the printing cycle, remains poised above the level of the articles to be printed as the conveyor 135 continues to move. When the next article A-3 has moved into position below the printing element 37, the conveyor is again stopped and a signal from the conveyor system restarts the printing unit 21, whereupon the sequence of operations illustrated in FIGS. 5–12 is repeated. The printing cycle is repeated again for the next article A-4 and for all succeeding articles on the conveyor 135.

MOUNTING BLOCK ASSEMBLY

Figures 13, 15:
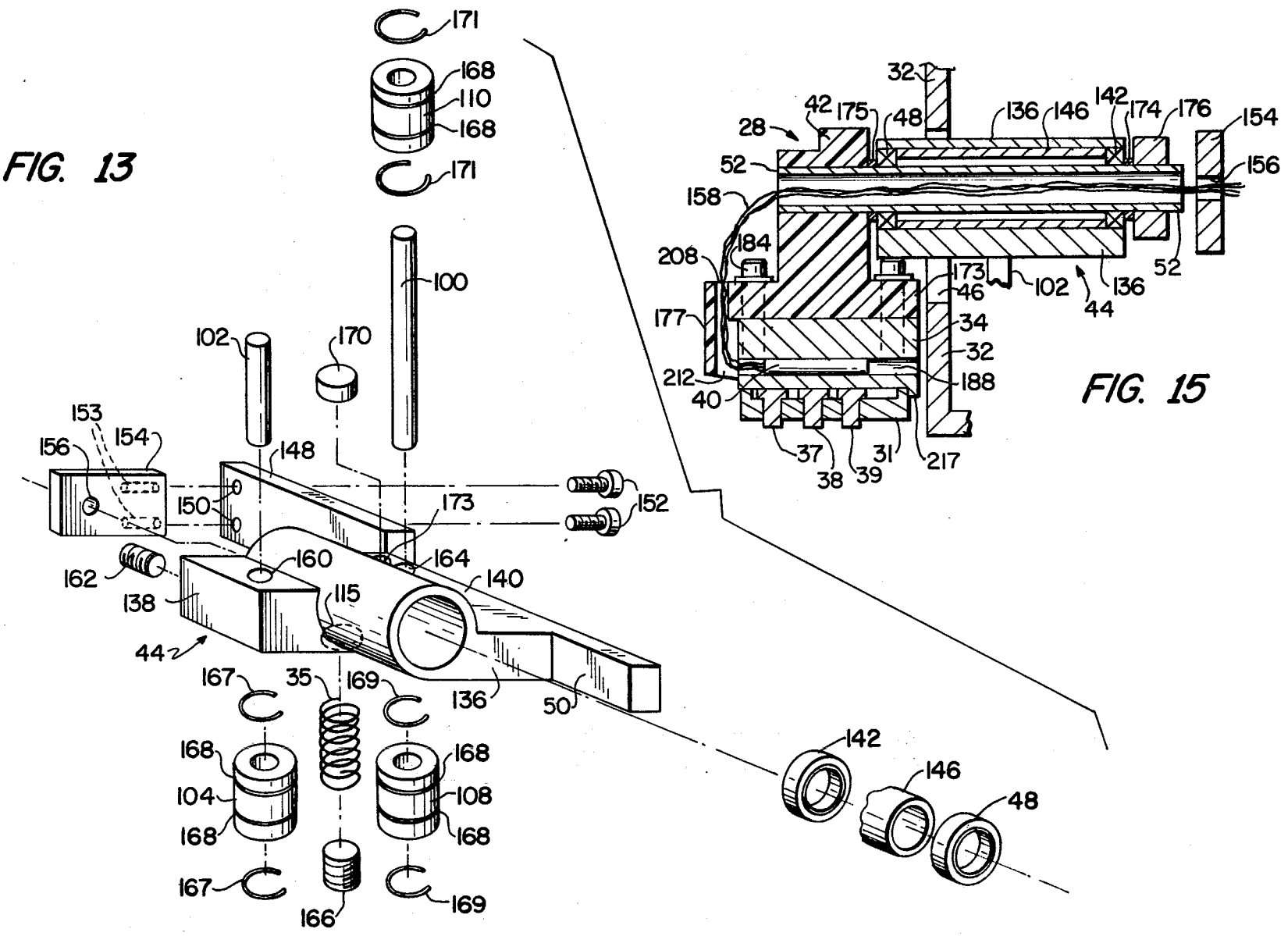
FIG. 13 is an exploded perspective view of the resiliently supported mounting block assembly used in the printing unit of FIGS. 1–4.
FIG. 15 is a sectional view illustrating the mounting of the printing member of FIG. 14 within the mounting assembly of FIG. 13.

FIG. 13 is an exploded perspective view of the resilient mounting assembly which forms the support means for the pivoting printing member 28 of FIG. 1. Included in this assembly is the mounting block 44, which as already been described to some extent in connection with FIGS. 1–4. The mounting block 44, which is preferably made from cast aluminum or a like material, includes a central barrel portion 136 and two depending side portions 138 and 140. The interior of the barrel 136 is fitted with a pair of radial ball bearing units 48 and 142 separated by a tubular spacer 146. The ball bearing units 48 and 142 are bonded to the interior of the barrel 136 and provide a pivotable support for the hollow shaft 52 of the printing member 28 as will be described in more detail in connection with FIGS. 14 and 15. The mounting block 44 also includes a rear extension 148 which is provided with a pair of holes 150 for receiving cap screws 152. The cap screws 152 extend through the holes 150 and engage tapped holes 153 in a rear cross-member 154 for securing the same to the end of the rear extension 148. The rear cross-member 154 contains a hole 156 through which wires are passed for establishing electrical connection to the resistance heating elements and thermistor installed in the lower portion of the printing member 28 of FIG. 1. These wires, which are indicated at 158 in FIG. 1 but are omitted from FIG. 13, also pass through the hollow shaft 52 of the printing member 28 while the latter is received within the barrel portion 136 of the mounting block 44, at which point they are accessible for connection to the lower portion of the printing member. The hole 156 is preferably made small enough so that the wires are tightly gripped. The purpose of the rear cross-member 154 is to provide support for the wires 158 as they enter the barrel portion 136 of the mounting block 44, and also to insure that these wires do not become twisted as the printing member 28 moves back and forth between the print-ready and non-printing positions. It should be pointed out that the rear cross-member 154 has been omitted from previous Figures in order to more clearly illustrate the details of the rear portion of the mounting block 44.

With continued reference to FIG. 13, the side extension 138 of the mounting block 44 is provided with a vertical bore 160 for receiving the vertical slide rod 102. A set screw 162 engages a tapped hole 159 (visible in FIG. 3) formed through the rear face of the side extension 138 and exerts clamping pressure on the slide rod 102 in order to rigidly attach the slide rod 102 to the mounting block 44. A flattened area (not shown) is preferably formed near the upper end of the slide rod 102 in order to accommodate the end of the set screw 162. In its assembled condition, the slide rod 102 extends out through the bottom opening of the bore 160 and is slidably received by the linear ball bushing 104. The ball bushing 104 is rigidly seated within a bore formed in the lower boss 106 of the printing unit housing 22 as described earlier in connection with FIG. 3. The ball bushing 104 thus serves as a bearing for enabling the vertical sliding motion of the slide rod 102 and the attached mounting block 44 with respect to the housing 22 and vertical wall 32 of the printing unit.

In a similar manner, the slide rod 100 passes through a vertical bore 164 formed in the side extension 140 of the mounting block, and is rigidly clamped therein by means of a set screw (not shown) and tapped hole 161 (visible in FIG. 3) similar to thoseprovided for the slide rod 102. A flattened area (not shown) is preferably formed at an intermediate point on the slide rod 100 in order to accommodate the end of the set screw. The slide rod 100 is longer than the slide rod 102, and in its installed position protrudes from the bore 164 both above and below the side extension 140 of the mounting block 44. The lower end of the slide rod 100 is slidably received by a second linear ball bushing 108, the latter being rigidly seated in the lower boss 106 of the printing unit housing 22 as shown in FIG. 3. The upper end of the slide rod 100 is slidably received by a third linear ball bushing 110, which is rigidly seated in the upper boss 112 of the printing unit housing 22 in the position shown in FIG. 3. The two slide rods 100 and 102 cooperate to permit guided vertical movement of the mounting block 44 along a straight-line path in response to forces exerted on the printing member 28 of FIG. 1 by the drive system or on the mounting block 44 by the spring 35.

As noted earlier, the ball bushings 104, 108 and 110 of FIG. 5 are preferably Thomson No. A-4812 linear ball bushings, which are available from Thomson Industries, Inc. of Manhasset, N.Y. C-shaped retaining rings 167, 169 and 171 are received by peripheral grooves 168 in the ball bushings and serve to secure the ball bushings to the adjacent edge surfaces of the respective lower and upper bosses 106 and 112 in the manner illustrated in FIG. 3.

The coil spring 35 is positioned to exert a biasing force on the mounting block in the upward direction. To this end, the lower end of the spring 35 is seated in a tapped hole 114 formed through the lower boss 106 of the printing unit housing, as illustrated in FIG. 3, and the upper end of the spring is seated in a shallow hole 115 formed in the lower surface of the mounting block 44. A set screw 166 is received in the bottom portion of the tapped hole 114. The spring 35 is thus maintained in compression between the top of the set screw 116 and the bottom of the mounting block 44. As noted earlier in connection with FIG. 3, raising of the set screw 166 will increase the compressive force on the spring 35 and will therefore increase the preload or restoring force tending to maintain the mounting block 44 in its raised or retracted position. Conversely, adjusting the set screw 166 to a lower position within the hole 114 will reduce the compressive force on the spring 35 and hence will reduce the upward preload or restoring force acting on the mounting block 44.

A small resilient bumper 170 is bonded into a shallow hole 173 formed in the upper surface of the side extension 140 of the mounting block 44 a short distance behind the bore 164. The bumper 170 is positioned so that it is brought into contact with the upper boss 112 of the printing unit housing, shown in FIG. 3, when the mounting block 44 is in its fully raised or retracted position. The bumper 170 thus acts as a cushion for absorbing the impact of the mounting block 44 against the printing unit housing as the mounting block moves upward after printing under the influence of the spring 35.

The mounting block 44 also includes an integral stop member 50 which projects out in the forward direction from the side extension 140. When the mounting block 44 is installed in the printing unit 21 in the position illustrated in FIGS. 1–3, the stop member 50 extends out into the arcuate path of the printing member 28 and serves as a projecting abutment for temporarily arresting the motion of the printing member at the print-ready position. As noted earlier, this permits the printing member drive means to exert a momentary downward force on the printing member 28, which forces the mounting block 44 to move in a downward direction guided by the slide rods 100, 102 and ball bushings 104, 108, 110. This brings the printing element 37 carried by the printing member 28 into contact with the article to be printed. After printing is completed, the mounting block 44 and printing member 28 are again moved upward to the retracted position due to the restoring force exerted by the spring 35.

PRINTING MEMBER ASSEMBLY

The printing member 28 of FIG. 1 is illustrated in more detail in FIGS. 14 and 15. FIG. 14 is an exploded perspective view of the printing member 28 and its associated components. FIG. 15 is a sectional view of illustrating the assembled printing member 28 and also illustrating a portion of the resiliently supported mounting block 44 of FIG. 13.

Referring first to FIG. 14, the printing member 28 generally comprises a lower L-shaped potion 172 and a short upper arm portion 42. The upper arm portion 42 and lower L-shaped portion 172 may be molded in one piece from a suitable heat-resistant plastic material, such as Valox. The upper arm portion 42 is molded over and rigidly affixed to the hollow shaft 52 which constitutes the pivot shaft of the printing member 28. The hollow shaft 52 is dimensioned to be received within the barrel portion 136 of the mounting block 44 of FIG. 5 and rotatably supported by the radial ball bearing units 48 and 142 retained therein, as illustrated in FIG. 15. A spacer 175, visible in FIG. 15, is provided between the inner race of the bearing 48 and the rear face of the upper arm portion 42. The spacer 175 may be made integral with the upper arm portion 42 of the printing member 28 if desired. An additional spacer 174 is provided between the inner race of the bearing 142 and a retaining collar 176. The collar 176 is affixed to the part of the hollow shaft 52 which protrudes through the rear bearing 142 in the barrel portion 136 of the mounting block 44. A screw 177 holds the collar 176 in place on the shaft 52, and the collar 76 thereby serves to lock the printing member 28 in position with respect to the mounting block 44. As shown in FIG. 15, the collar 176 is located between the rear opening of the barrel 136 and the rear cross-member 154 of the mounting block 44 when the printing member is in place.

The L-shaped portion 172 of the printing member 28 comprises a horizontal section 173 and a forwardly positioned vertical section 177. The horizontal section 173 of the L-shaped member 172 is penetrated by two vertical holes, one of which is indicated at 182 in FIG. 14, on either side of the upper arm portion 42. The holes 182 are for the purpose of receiving a pair of cap screws 184, which pass through the L-shaped member 172 and engage corresponding tapped holes 189 in the top of a heater block 34. The heater block 34 is thereby secured to the interior surfaces of the L-shaped member 172 in a nested manner, with the forward surface of the heater block 34 held in abutting contact with the rear surface of the vertical section 175. Spring-type lock washers 185 and plain washers 187 are provided to prevent loosening of the cap screws 184 during movement of the printing member 28.

The heater block 34 is made from a suitable heat conductive material, such as aluminum, and includes horizontal through-holes 186, 188 and 190 for receiving, respectively, a first electrical resistance heating element 36, a thermistor 40, and a second electrical resistance heating element 38. As illustrated in FIG. 15, the wires 158 leading to these components pass through a hollow area or cavity 212 formed in the rear face of the vertical section 177 of the L-shaped member 172, and then emerge through a pair of holes 208, 210 formed through the forward part of the horizontal section 173. The wires 158 then pass through the hollow shaft 52 of the printing member 28 and through the hole 156 in the rear cross-member 54 of the mounting block 44 as described previously. After emerging from the hole 156, the wires 158 are connected to the appropriate points on the terminal block 98 of FIG. 3.

Referring once again to FIG. 14, tapped holes 192 are provided in the right side of the heater block 34 for the purpose of receiving a pair of cap screws 194, the latter serving to attach a master plate clamp 196 to the right-hand side of the heater block. The master plate clamp 196 is provided with elongated holes 199 in positions corresponding to the tapped holes 192 in the heated block 34. A similar master plate clamp 197 with elongated holes 201 is attached to the left-hand side of the heater block 34 by means of a further pair of cap screws 198, these being received in an additional set of tapped holes (not shown) formed in the left-hand side of the heater block. Washers 200 and 202 are provided for preventing loosening of the respective pairs of cap screws 194 and 198 while the printing member 28 is in motion.

The lower edges of the master plate clamps 196 and 197 are bent slightly inward, as shown, for the purpose of affixing a master plate 31 to the lower surface of the heater block 34. The master plate 31 may be made of a suitable heat-resistant plastic material, such as Valox, and contains a shallow rectangular cavity 203 in the top surface thereof. Rectangular slots 205, 207 and 209 are formed vertically through the master plate 31 within the cavity 203 for the purpose of receiving an equal number of printing elements 37, 38 and 39. The printing elements 37, 38 and 39 comprise one-piece metal bars of printing type with raised printing indicia (not shown) on their lower surfaces and peripheral flange portions 211, 213 and 215 along their upper edges. The type bars 37, 38 and 39 are received through the slots 205, 207 and 209 in the master plate 31 with the flange portions 211, 213 and 215 of the type bars resting in the cavity 203. When the master plate 31 is affixed to the heater block 34 by means of the clamps 196 and 197, the type bars 37, 38 and 39 project through the slots 205, 207 and 209 in the master plate with the raised indicia side of each type bar facing downward. The flat upper flange portions 211, 213 and 215 of the type bars extend slightly above the top of the cavity 203 in the master plate 31 and are therefore maintained in firmly abutting contact with the flat underside of the heater block 34 as shown in FIG. 15. The lower surface of the heater block 34 includes a retaining lip 217 along its rear edge, which assists in properly seating the master plate 31. The elongated holes 199 and 201 in the respective master plate clamps 196 and 197 permit a limited degree of vertical adjustment of the master plate clamps relative to the heater block 34, which allows for some variation in thickness among different master plates. The elongated holes 199 and 201 also eliminate the need for close tolerances in the bent lower portions of the master plate clamps 196 and 197.

Heat generated by the resistance heating elements 36 and 38 is conducted uniformly throughout the heater block 34 and is transmitted by conduction to the metal printing elements 37, 38 and 39 for the purpose of maintaining the ink thereon in a liquid state until it is applied to the surface of the article to be printed. In the preferred embodiment, wherein the heater block comprises a block of aluminum having a thickness of about 19/32 inch, a power rating of about 14 watts for each of the resistance heating elements 36 and 38 is sufficient to maintain the heater block 34 and the attached printing element 37 at a temperature within the desired range of about 250°-300° F. The resistance heating elements 36 and 38 may comprise No. SC2S1/14W/28V/SF1-14 devices which are available from Hotwatt, Inc., of Danvers Mass. The thermistor 40 senses the temperature within the heater block 34 and controls the electrical current to the resistance heating elements 36 and 38 so that a uniform temperature is maintained. The thermistor 40 is preferably a No. 1102N010C2P3-04 device, which is available from Thermologic, a division of Dytron, Inc., Waltham, Mass. The details of the electrical circuitry for controlling the heating elements 36 and 38 by means of the thermistor 40 will be given hereinafter in connection with FIG. 25.

A brass grounding screw 180 is received in a tapped hole 181 formed in the top surface of the heater block 34. A ground wire (not shown) leads from the screw 180 to a grund terminal of the printing unit 21 in order to provide electrical grounding for the heater block 34 in the event that the latter becomes connected to the supply potential provided to the electrical resistance heating elements 36 and 38 due to an electrical short or the like.

The upper arm portion 42 of the printing member 28 is provided with a tapped brass insert 214, located below and to the left of the hole for the hollow pivot shaft 52, in order to allow attachment of the lower end of the connecting link 64 to the printing member. The lower end of the connecting link 64 includes a hole 216 which is dimensioned to receive a radial ball bearing unit 68. A cap screw 220 passes through the ball bearing unit 68 and engages the tapped hole 214 in the upper arm portion 42 of the printing member. A bearing spacer 222 is provided between the inner race of the bearing 68 and the outer face of the upper arm portion 42 of the printing member. This arrangement provides a freely pivotable connection between the lower end of the connecting link 64 and the printing member 28. A similar arrangement including a cap screw 224, radial ball bearing unit 66, and bearing spacer 228 is provided through a second hole 230 at the upper end of the connecting link 64 to allow the latter to be pivotally connected to a point near the periphery of the crank disk 62 of FIG. 1.

With continued reference to FIG. 14, a resilient bumper 178 is bonded into a shallow hole 231 formed in the right-hand side of the upper arm portion 42 of the printing member 28. When the printing member 28 is mounted in the resiliently supported mounting block 44 of FIG. 13, the stop member 50 of the mounting block 44 extends approximately to the forward edge of the upper arm portion 42 when the printing member 28 is in the print-ready position as shown in FIG. 1. The resilient bumper 178 of the printing member 28 is positioned to be brought into contact with the flat inside face of the stop member 50 in order to bring the coasting printing member 28 to a gentle halt at the end of the printing cycle.

INK RESERVOIR ASSEMBLY

Figure 17:
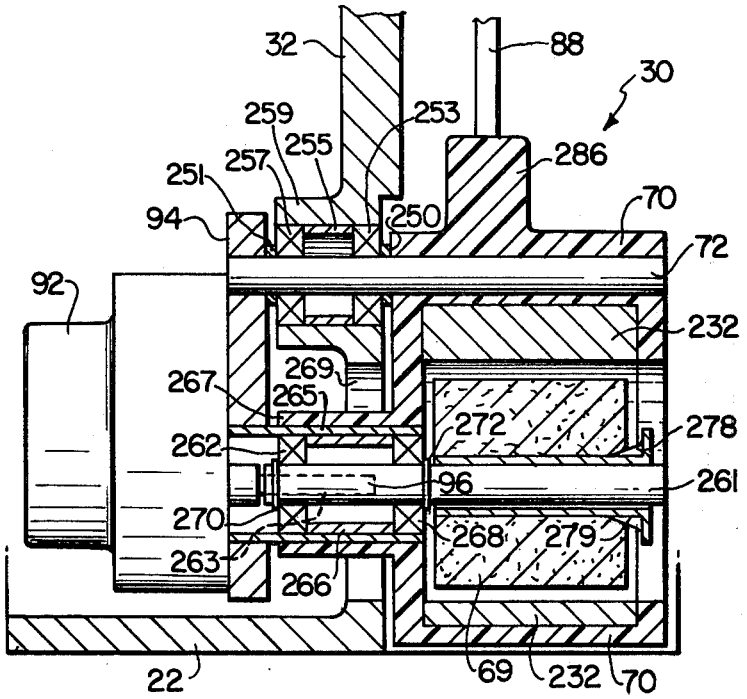
FIG. 17 is a sectional view illustrating the mounting of the inking roll assembly of FIG. 16 with respect to the printing unit housing.
Figure 18:
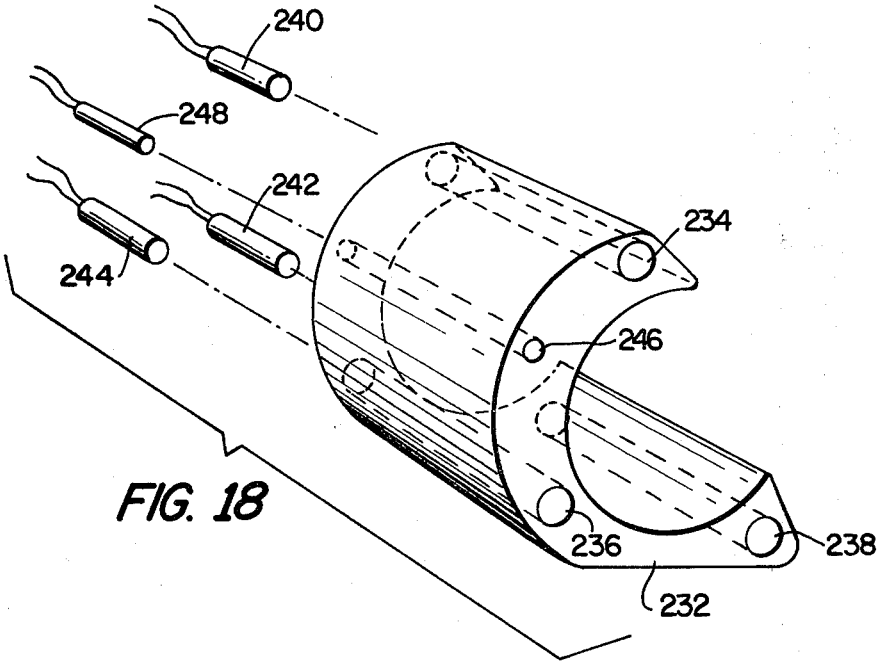
FIG. 18 is an exploded perspective view of the inking roll heater block which forms a part of the inking roll assembly of FIG. 16.

The details of the inking roll assembly 30 are illustrated in FIGS. 16–18. FIG. 16 is an exploded perspective view of the inking roll assembly 30 and its associated components. FIG. 17 is a sectional view illustrating the manner in which the inking roll assembly 30 is mounted with respect to the housing of the printing unit 21. FIG. 18 is an exploded view of the inking roll heater block 232 which forms a part of the inking roll assembly 30 of FIG. 16.

Referring first to FIG. 16, the inking roll assembly 30 includes a housing 70 which is preferably made of a suitable heat-resistant plastic material, such as Valox. The housing 70 surrounds and supports a semi-cylindrical heater block 232. The heater block 232, which is shown in more detail in FIG. 18, is made of a heat conducting material such as cast aluminum. The heater block 232 is provided with three approximately equally spaced holes 234, 236 and 238, extending along its entire length, for receiving an equal number of electrical resistance heating elements 240, 242 and 244. A fourth hole 246 is provided between the holes 234 and 236 for receiving a thermistor 248. Heat generated by the elements 240, 242 and 244 is conducted uniformly through the heater block 232, with the thermistor 248 serving to maintain a uniform temperature as will be described hereinafter in connection with FIG. 24. When the heater block 232 is made of cast aluminum having a thickness of about 11/32 inch, as in the preferred embodiment, a power rating of about 14 watts for each of the elements 240, 242 and 244 is sufficient to maintain the heater block 232 at a temperature within the desired range of about 300°-350° F. The resistance heating elements 240, 242, 244 and the thermistor 248 may be of the same type as the resistance heating elements 36, 38 and thermistor 40, respectively, used in the printing member heater block 34 of FIG. 14. Heat radiated by the inking roll heater block 232 maintains the inking roll 69 of FIG. 14 at an elevated temperature and insures that the ink composition impregnated in the inking roll remains in a liquid or flowable state. The inking roll heater block 232 is preferably provided with a grounding screw (not shown) similar to the grounding screw 180 of FIG. 14 to allow a ground wire to be connected to the heater block 232.

The upper part of the ink reservoir housing 70 in FIG. 16 is fitted with a rigidly attached pivot shaft 72, which is preferably molded into the housing 70 when the latter is made of a plastic material. The pivot shaft 72 extends rearwardly of the housing 70, passing through a radial ball bearing unit 253, a tubular bearing spacer 255, and a second radial ball bearing unit 257. The bearings 253, 257 and spacer 255 are retained in a cylindrical boss 259 which is formed in the vertical wall 32 of the printing unit 21 as shown in FIG. 17. On the opposite side of the wall 32, the pivot shaft is received in a hole 252 formed in the top portion of the motor plate 94. A bearing spacer 251 is provided between the motor plate 94 and the inner race of the bearing 257, and a similar bearing spacer 250 is provided between the housing 70 and the inner race of the bearing 253. A set screw 254 is received in a small tapped hole 256 formed through the top surface of the motor plate 94 in order to exert clamping pressure on the end of the pivot shaft 72. This serves to rigidly attach the pivot shaft 72 to the motor plate 94. In this way, the housing 70 and the motor plate 94 will move as a unit as the inking roll assembly 30 is rocked from side to side about the axis of the pivot shaft 72.

A small A.C. motor 92 is attached to the lower portion of the motor plate by means of a screw 258 and tapped hole 260. As best seen in FIG. 17, the offset shaft 96 of the motor 92 is rigidly received within a cavity 263 formed in the rear part of the inking roll shaft 261. The motor shaft 96 preferably includes a flattened area which can be engaged with a key formed within the cavity 263 by crimping or otherwise deforming the inner end of the inking roll shaft 261. The inking roll shaft 261 is rotatably supported by first and second radial ball bearing units 262 and 268, which are separated by a tubular spacer 266. The bearings 262, 268 and spacer 266 are received within an aluminum bearing sleeve 265 which is molded into a cylindrical boss 267 extending from the rear part of the housing 70 of the inking roll assembly. The part of the outer surface of the bearing sleeve 265 which is covered by the boss 267 is preferably knurled in order to insure maximum adhesion to the plastic material used for the housing 70 and boss 267. The projecting part of the bearing sleeve 265 is fitted tightly within a hole 264 formed in the bottom portion of the motor late 94. C-shaped retaining rings 270 and 272 are received in respective grooves 274 and 276 formed on the rear part of the inking roll shaft 261 in order to hold the ball bearing units 262 and 268 and tubular spacer 266 in position within the sleeve 265. The boss 267 and bearing sleeve 265 pass through an enlarged clearance opening 269 in the vertical wall 32 of the printing unit. This opening is of sufficient size to allow full clearance for the boss 267 as the inking roll assembly 30 and the motor plate 94 rock from side to side about the axis of the pivot shaft 72.

The inking roll shaft 261 is rotated by the shaft 96 of the motor 92 at a constant speed of about 120 RPM in order to impart continuous rotation to the inking roll 69. The motor 92 operates independently of the printing member drive motor 90 of FIG. 3 and thus imparts continuous rotation to the inking roll 69 during and between successive printing cycles. Powered rotation of the inking roll 69 is advantageous because it allows the peripheral speed of the inking roll to be approximately matched to the speed of the printing element 37 of FIG. 1 when these components initially make contact with each other. This tends to produce less wear on the inking roll 69 than would be possible with a freely rotating inking roll, since in the latter case the inking roll is initially at rest and must be brought up to speed by frictional contact with the printing element. This usually involves some degree of initial slippage between the inking roll and the printing element, due to the rotational inertia of the inking roll, and as a result the wear on the inking roll after many printing cycles may be considerable. Continuous rotation of the inking roll 69 by the motor 92 substantially avoids this problem in the present invention.

The inking roll 69 preferably comprises a cylindrical body of porous foam material which has been impregnated with an ink composition of the type already described. A cylindrical plastic device 278 with raised vanes or grips 279 is forced into the hollow center of the inking roll to serve as a hub. The hub 278 engages the center of the inking roll 69 tightly but has a loose running fit over the inking roll shaft 261 as shown in FIG. 17. This allows a considerable degree of slippage between the inking roll 69 and the shaft 261, which permits the inking roll 69 to rotate faster or slower than the shaft 261. This is useful in instances where the speed of the printing member 28 of FIG. 1 is such that the printing element 37 is moving either faster or slower than the peripheral velocity of the inking roll 69 during the period of initial contact between the two. In such cases, slippage between the hub 278 and shaft 261 allows the peripheral velocity of the inking roll 69 to increase or decrease in accordance with the speed of the printing element 37 as frictional contact is established between these parts. Therefore, while the motor 92 provides an approximate initial match between the inking roll and printing element speeds, and avoids the need for the inking roll to accelerate from a rest when it first contacts the printing element, the slippage between the hub 278 and the inking roll shaft 261 allows the peripheral speed of the inking roll 69 to be matched exactly to the speed of the printing element 37 shortly after contact is established between these two parts. This minimizes the wear on the inking roll 69 over many printing cycles.

The top portion of the inking roll assembly house 70 is provided with an integral projection 286 for receiving a rigidly attached tie bar 88. The tie bar 88 may be molded into the projection 286 when the housing 70 is made of a plastic material as in the preferred embodiment. The tie bar 88 is provided with a pair of holes 290 and 292 which align with a corresponding pair of tapped holes 294 and 296 formed at the lower end of the follower arm 76. Cap screws 298 and 300 pass through the holes 290, 292 and engage the tapped holes 294, 296 in order to firmly secure the follower arm 76 to the tie bar 288. A spring-type washer 302 is used in combination with a plain washer 304 to assist in securing the top cap screw 298. A single external-tooth lock washer 306 is used to secure the bottom cap screw 300. The top hole 290 in the tie bar 288 is slightly oversized to allow fine adjustments in the position of the inking roll assembly 30. This is accomplished essentially by pivoting the housing 70 through a very small arc centered on the lower cap screw 300. The upper cap screw 298 is slightly lower than the lower cap screw 300, allowing it to protrude slightly beyond the rear surface of the follower arm 76 to act as a mounting point for the coil spring 80. The coil spring 80 is maintained in tension between the follower arm 76 and a pin 81 which is press-fitted into the vertical wall 32 of the printing unit 21 as shown in FIGS. 1 and 2.

A stud 308 is bonded into a hole at the top of the follower arm 76 and serves as a support for the cam follower 78. The cam follower 78, which preferably comprises a radial ball bearing unit having its inner race bonded to the stud 308, is urged into contact with the contoured surface of the cam 60 in FIG. 1 as a result of the biasing force exerted of the follower arm 76 by the spring 80. Thus it will be appreciated that follower arm 76 will be displaced inwardly and outwardly relative to the drive shaft 58 of FIG. 1 as the cam 60 rotates, resulting in a cyclical rocking motion of the inking roll assembly 30 about the axis of the pivot shaft 72 as described earlier.

The top of the follower arm 76 is also provided with a tapped hole 310, located below and to the left of the stud 308 as shown. The tapped hole 310 is dimensioned for receiving a cap screw 312, the latter serving to attach the metallic vane 82 to the top portion of the follower arm 76. The metallic vane 82 cooperates with the Hall effect switch 84 of FIGS. 1 and 2 to produce a stop signal somewhat in advance of the end of a complete printing cycle as already noted. The vane 82 is provided with an elongated hole or slot 314 through which the cap screw 312 passes. This allows the position of the vane 314 to be adjusted relative to the follower arm 76, which permits the timing of the stop signal produced by the Hall effect switch 84 to be varied. A washer 316 is interposed between the vane 314 and the head of the cap screw 312 in order to assist in securing the vane 314 in its adjusted position relative to the follower arm 76.

INKING CAM AND CRANK DISK

As already noted, the cam 60 which controls the rocking movement of the inking roll assembly 30 in FIGS. 1 and 2 has two distinct functions in the present invention. In the first place, the cam 60 is required to rock the inking roll assembly in a cyclical manner such that the inking roller 69 is brought into contact with the printing element 37 only once during a complete cycle of movement of the printing member 28. This is desirable in order that the printing element 37 be brought into contact with the periphery of the inking roll 69 when both are moving in the same direction. Preferably, but not necessarily, such contact between the inking roll and the printing element occurs when the printing member 28 is executing its return movement from the non-printing position to the print-ready position, with the printing element 37 and inking roll 69 remaining separated during the initial movement of the printing member from the print-ready position to the non-printing position. The second function of the cam 60 is to insure that the periphery of the inking roll 69 remains in uniform contact with the printing element 37 as the line of contact between the inking roll 69 and the printing element 37 moves across the face of the printing element. Both of these functions can be carried out by the selection of an appropriate contour for the cam 60 as will now be described.

Figure 19:
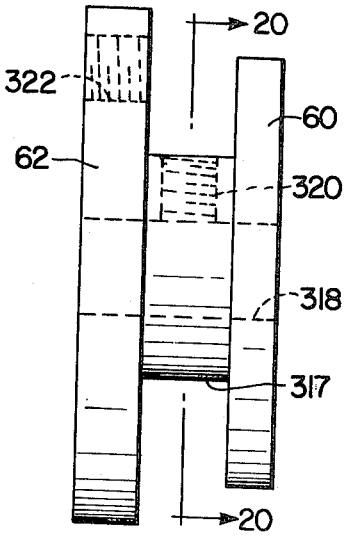
FIG. 19 is a side elevational view of the cam used to control the movement of the inking roll assembly of FIGS. 16–18, together with the attached crank disk which forms a part of the drive system for the pivoting printing member of FIGS. 14 and 15.

FIG. 19 is a side elevational view of the cam 60 and the attached crank disk 62, which are preferably formed as a one-piece unit with an intermediate spacer portion 317. A central bore 318 is formed axially through the cam 60, spacer 317, and crank disk 62 to accommodate the motor shaft 58 of FIGS. 1–3. A transverse tapped hole 320 is provided in the spacer portion 317 to accommodate a set screw (not shown) that is used to affix the cam 60 and crank disk to the motor shaft 58 of FIGS. 1 and 2. A further tapped hole 322 is formed in the axial direction through the periphery of the crank disk 62. The tapped hole 322 accommodates the cap screw 224 of FIG. 6 and thus serves as the connection point between the crank disk 62 and the connecting link 64 to the printing member 28. The cam 60, crank disk 62 and spacer 316 may be made from any suitable material, although stainless steel is preferred in the interest of durability and resistance to rusting.

Figure 20:
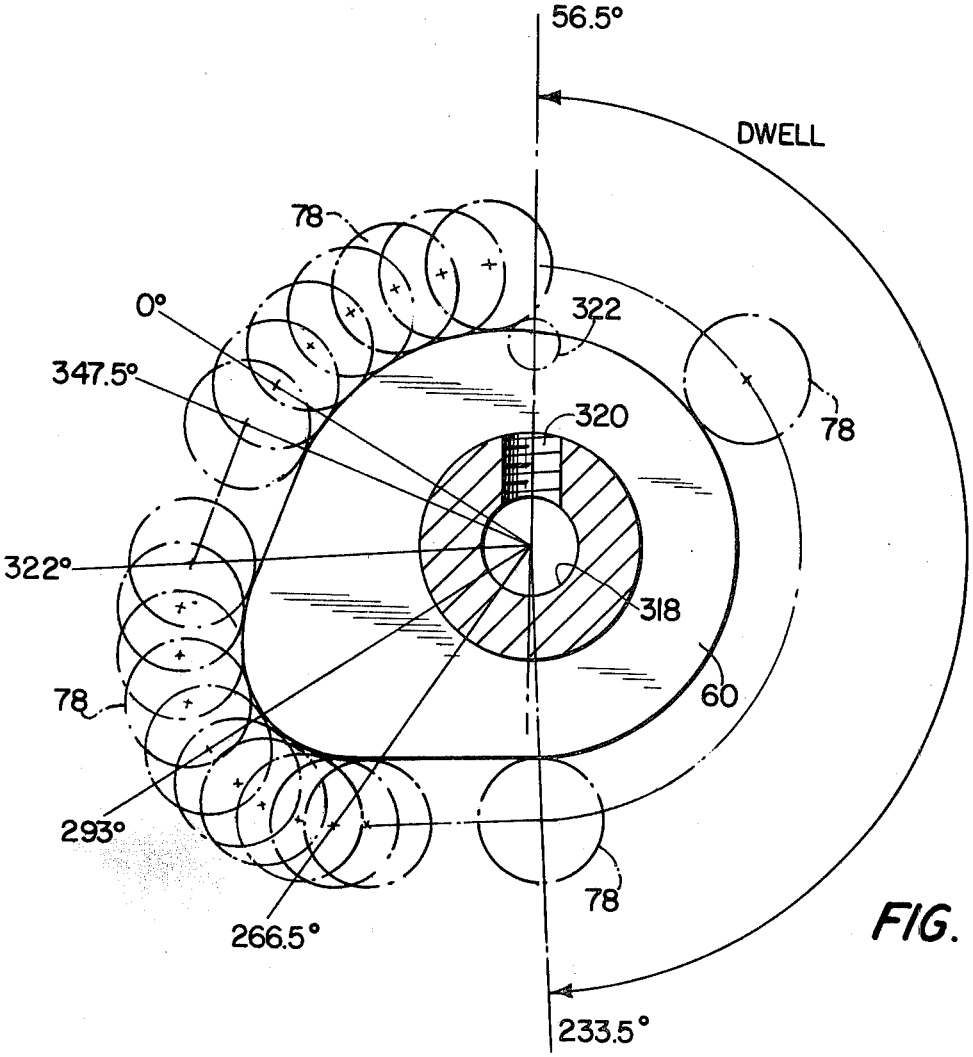
FIG. 20 is a sectional view taken along the line 20—20 in FIG. 19, illustrating the contour of the cam which controls the movement of the inking roll assembly.

FIG. 20 is a sectional view taken along the line 20—20 in FIG. 19, illustrating the contour of the cam 60. For reference, the position of the tapped hole 322 has been illustrated in FIG. 20, although it should be understood that this hole is formed in the crank disk 62 and not in the cam 60. Also shown are the number of sequential positions of the cam follower 78 of FIGS. 1–2, illustrating the manner in which the cam follower (and hence the attached follower arm 76, which is not shown) moves alternately closer and farther away from the central axis of the cam 60 as the cam rotates. Of course, it should be realized that the cam follower 78 remains in the same radial position while the cam 60 rotates, rather than vice-versa, and therefore the sequential positions of the cam follower 78 should be viewed merely as representing different displacements of the cam follower along a fixed radial line.

The 0° point of the cam 60 is arbitrary and has been chosen merely as a reference point. The axis of the tapped bore 322, which is the point of connection between the crank disk 62 and the connecting link 64, is positioned approximately at the 54° point. The cam follower 78 is located approximately at the 228° position when the printing member is in the position shown in FIG. 5. The cam radius at the 228° point will therefore define the rest position of the ink reservoir 30 between successive printing cycles.

Table 1 provides the effective radius of the cam 60 (expressed in inches) measured to the center of the cam follower 78, for a number of different angular positions (expressed in degrees) of the cam. The actual cam radius at each point can be determined by subtracting the radius of the cam follower 78 (given below), which then yields the equivalent of the displacement diagram for describing the contour of the cam 60. Pertinent dimensions to be taken into account in connection with Table 1 are as follows:

Radius of cam follower 78: 0.250 inch

Center-to-center distance between stud 308 and pivot shaft 72: 3.552 inches Center-to-center distance between pivot shaft 72 and inking roll shaft 261: 1.511 inch Horizontal distance between axis of pivot shaft 72 and axis of inking roll shaft 261 (with inking roll assembly in fully retracted position): 0.750 inch Diameter of inking roll 69: 1.400 inches Maximum linear rocking distance of inking roll assembly 30 to bring inking roll 69 into contact with printing element 37, measured at axis of inking roll shaft 261: 0.186 inch Maximum length of printing element 37 between leading and trailing edges: 1.071 inches Vertical distance between axis of motor shaft 58 and axis of pivot shaft 72: 2.125 inches Horizontal distance between axis of motor shaft 58 and axis of pivot shaft 72: 3.218 inches Vertical distance between axis of motor shaft 58 and axis of hollow printing member shaft 52: 2.500 inches Horizontal distance between axis of motor shaft 58 and the axis of hollow shaft 52 (hollow shaft 52 offset in right-hand direction in FIG. 1): 0.156 inch Effective radius of printing member 28, measured from axis of hollow shaft 52 to center of printing element 37: 2.000 inches Center-to-center distance between pivot bearings 66 and 68 (effective length of connecting link 64): 2.485 inches Center-to-center distance between pivot bearing 68 and hollow shaft 52: 0.868 inch Center-to-center distance between motor shaft 58 and pivot bearing 66: 0.757 inch Linkage ratio (inches of movement of inking roll 69 per one-inch change in cam radius): 0.425

It should be understood that the foregoing dimensions and those given in Table 1 are presented by way of example only and are not intended to limit the scope of the present invention in any way.

TABLE 1

| Angle | Radius | Angle | Radius | Angle | Radius | Angle | Radius | Angle | Radius |
|---|---|---|---|---|---|---|---|---|---|
| 0.5° | 1.175 | 27.5° | 1.121 | 54.5° | 1.067 | 283° | 1.470 | 310° | 1.436 |
| 1.5° | 1.173 | 28.5° | 1.119 | 55.5° | 1.065 | 284° | 1.476 | 311° | 1.429 |
| 2.5° | 1.171 | 29.5° | 1.117 | 56.5° | 1.063 | 285° | 1.481 | 312° | 1.422 |
| 3.5° | 1.169 | 30.5° | 1.115 | DWELL | | 286° | 1.485 | 313° | 1.414 |
| 4.5° | 1.167 | 31.5° | 1.113 | 233.5° | 1.063 | 287° | 1.489 | 314° | 1.406 |
| 5.5° | 1.165 | 32.5° | 1.111 | STRAIGHT LINE | | 288° | 1.493 | 315° | 1.398 |
| 6.5° | 1.163 | 33.5° | 1.109 | 266.5° | 1.267 | 289° | 1.495 | 316° | 1.390 |
| 7.5° | 1.161 | 34.5° | 1.107 | 267.0° | 1.2743 | 290° | 1.497 | 317° | 1.381 |
| 8.5° | 1.159 | 35.5° | 1.105 | 267.5° | 1.2816 | 291° | 1.499 | 318° | 1.372 |
| 9.5° | 1.157 | 36.5° | 1.103 | 268.0° | 1.2889 | 292° | 1.500 | 319° | 1.363 |
| 10.5° | 1.155 | 37.5° | 1.101 | 268.5° | 1.2962 | 293° | 1.500 | 320° | 1.354 |
| 11.5° | 1.153 | 38.5° | 1.099 | 269.0° | 1.3035 | 294° | 1.500 | 321° | 1.344 |
| 12.5° | 1.151 | 39.5° | 1.097 | 269.5° | 1.3108 | 295° | 1.499 | 322° | 1.333 |
| 13.5° | 1.149 | 40.5° | 1.095 | 270.0° | 1.3181 | 296° | 1.498 | STRAIGHT LINE | |
| 14.5° | 1.147 | 41.5° | 1.093 | 270.5° | 1.3254 | 297° | 1.496 | 347.5° | 1.202 |
| 15.5° | 1.145 | 42.5° | 1.091 | 271° | 1.333 | 298° | 1.494 | 348.5° | 1.199 |
| 16.5° | 1.143 | 43.5° | 1.089 | 272° | 1.347 | 299° | 1.491 | 349.5° | 1.197 |
| 17.5° | 1.141 | 44.5° | 1.087 | 273° | 1.363 | 300° | 1.488 | 350.5° | 1.195 |
| 18.5° | 1.139 | 45.5° | 1.085 | 274° | 1.378 | 301° | 1.485 | 351.5° | 1.193 |
| 19.5° | 1.137 | 46.5° | 1.083 | 275° | 1.392 | 302° | 1.481 | 352.5° | 1.191 |
| 20.5° | 1.135 | 47.5° | 1.081 | 276° | 1.405 | 303° | 1.477 | 353.5° | 1.189 |
| 21.5° | 1.133 | 48.5° | 1.079 | 277° | 1.417 | 304° | 1.472 | 354.5° | 1.187 |
| 22.5° | 1.131 | 49.5° | 1.077 | 278° | 1.428 | 305° | 1.476 | 355.5° | 1.185 |
| 23.5° | 1.129 | 50.5° | 1.075 | 279° | 1.438 | 306° | 1.461 | 356.5° | 1.183 |
| 24.5° | 1.127 | 51.5° | 1.073 | 280° | 1.447 | 307° | 1.456 | 357.5° | 1.181 |
| 25.5° | 1.125 | 52.5° | 1.071 | 281° | 1.455 | 308° | 1.449 | 358.5° | 1.179 |
| 26.5° | 1.123 | 53.5° | 1.069 | 282° | 1.463 | 309° | 1.443 | 359.5° | 1.177 |

In view of the fact that the initial position of the cam follower is approximately at the 228° point of the cam 60, and the fact that cam 60 rotates in the clockwise direction, Table 1 is best understood by reading backward from the 228° point/ This point occurs in a section of the cam extending from the 233.5° point to the 56.5° point, within which the radius of the cam 60 is constant and has its minimum value. This is indicated by the notation "DWELL" in Table 1 and in FIG. 20. This is the part of the cam which maintains the inking roll assembly 30 in its fully retracted position during the initial and final portions of the printing cycle depicted in FIGS. 5–12. Proceeding further in the direction of decreasing angle, the part of the cam between the 56.5° and 347.5° points in a section of gradually increasing radius which controls the initial movement of the inking roll assembly 30 toward the printing member 28 prior to actual contact between the inking roll 69 and the leading edge of the printing element 37. This is followed by a portion of linearly increasing radius between the 347.5° and 322° points, which is indicated by the notation "STRAIGHT LINE" in Table 1. This porton of the cam 60 moves the inking roll assembly 30 into position for initial contact between the periphery of the inking roll 69 and the leading edge of the printing element 37. The 322° point corresponds approximately to the line of initial contact between the leading edge of a 1 -inch printing element 37 and the periphery of the inking roll 69. The radius of the cam then increases further, albeit at a decreasing rate, until the 293° point is reached. This portion of the cam controls the gradual movement of the inking roll 69 toward the axis of the printing member shaft 52 as the line of contact between the inking roll and the printing element 37 progresses from the leading edge of the printing element to the median line of the printing element. The 293° point is the point of greatest radius of the cam and corresponds to the line of contact between the periphery of the inking roll 69 and the median line of the printing element 37. From the 293° point to the 266.5° point, the radius of the cam decreases at an increasing rate. This portion of the cam controls the gradual movement of the inking roll 69 away from the axis of the printing member shaft 52 as the line of contact between the inking roll and the printing element 37 progresses from the median line of the printing element to the trailing edge of the printing element. This is followed by a straight-line or linear decrease in the cam radius from the 266.5° point of the 233.5° point referred to earlier. This portion of the cam moves the inking roll assembly 30 back to its fully retracted position during the last part of the printing cycle.

Figure 21:
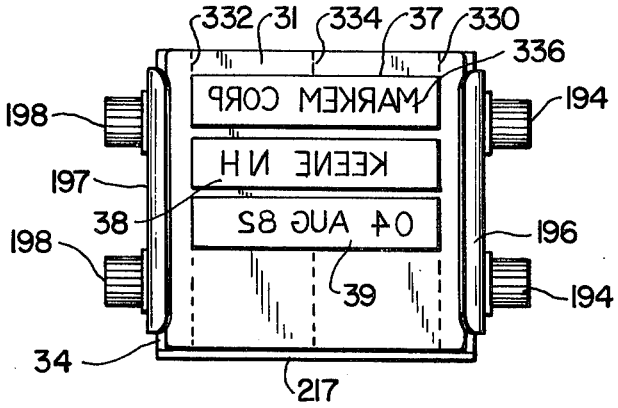
FIG. 21 is a bottom plan view of the pivoting printing member of FIGS. 14 and 15, illustrating a number of printing elements attached to the lower face thereof.
Figure 22:
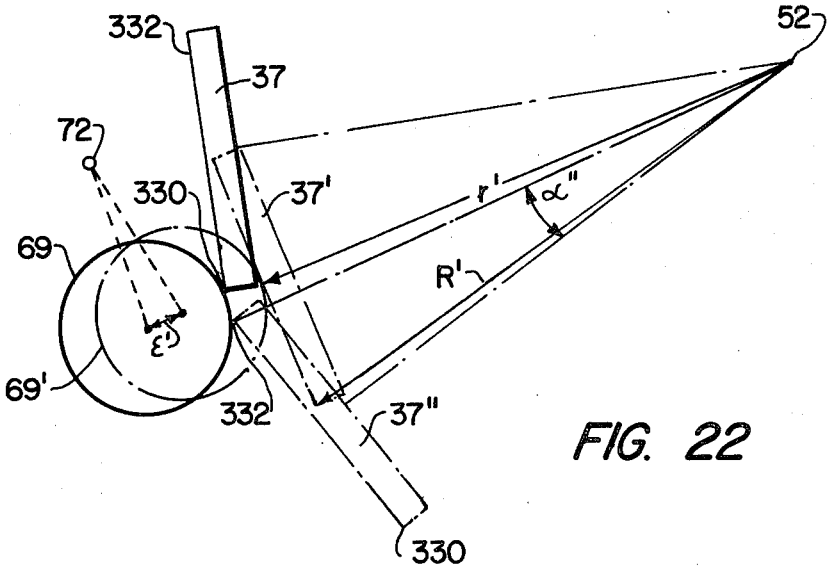
FIG. 22 is a diagrammatic view illustrating the sequential positions of the inking roll and a printing element during the inking portion of the printing cycle.

The function of the cam 60 in assuring uniform inking of the printing element 37 may best be understood by referring to FIGS. 21 and 22. FIG. 21 is a bottom view of the printing member 28 of FIGS. 1 and 14, illustrating the master plate 31 and the aligned printing elements 37, 38 and 39 carried thereby. Each printing element is substantially in the form of a flat plane with raised printing indicia 336 thereon, as shown, and each includes a leading edge 330, a trailing edge 332, and a median line 334. The leading edge 330 of the printing elements 37, 38 and 39 is the edge which first contacts the inking roll 69 during movement of the printing member 28 in the direction from the non-printing position to the print-ready position, as represented in FIGS. 10–12. The trailing edge 332 of the printing elements 37, 38, 39 is the edge which last contacts the inking roll 69 during movement of the printing member 28 in this direction. The median line 334 of the printing elements 37, 38, 39 is simply the line drawn halfway between the leading edge 330 and the trailing edge 332. As can be seen by comparing FIGS. 1 and 21, the pivot shaft 52 of the printing member 28 has its axis parallel to the plane of the printing elements 37, 38 and 39. In addition, the axis of the shaft 52 is intersected by an imaginary line drawn normal to the plane of the printing elements 37, 38, 39 and passing through the median line 334 of the printing elements. In other words, the plane defined by the printing elements 37, 38 and 39 extends perpendicularly to a radial line drawn vertically downward from the axis of the shaft 52 to the bottom of the printing member 28.

In FIG. 22, three successive positions of the printing element 37 are shown to illustrate the manner in which movement of the inking roll 69 is controlled by the cam 60 to achieve uniform inking of the printing element. If it is first imagined that the inking roll 69 is held stationary at its solid-line position in FIG. 22, as might be the case in the absence of the cam 60, it is clear that the inking roll will contact only the leading and trailing edges 330 and 332 of the printing die when the latter is in the positions 37 and 37″, respectively. The median line of the printing element has a reduced radius measured from the pivot axis 52 of the printing member and is therefore separated slightly from the inking roll 69 when the printing element is in the middle position 37′. With the cam 60 in place, however, the inking roll 69 is moved gradually inward in a direction toward the pivot axis 52 as the line of contact between the inking roll and the printing element progresses from the leading edge 330 of the printing element to the median line 334, eventually reaching the fully displaced position 69′. The position 69′ corresponds to the 293° point on the cam 60 in FIG. 20. The inking roll then moves gradually outward in a direction away from the pivot axis 53 as the line of contact between the inking roll and the printing element progresses from the median line 334 of the printing element to the trailing edge 332, and ultimately returns to its earlier position 69 when it is in contact with the trailing edge 332 of the printing element. This corresponds to the 266.5° point on the cam, assuming that the printing element is of the maximum allowed size. Due to the contour of the cam 60, the inking roll 69 is maintained at all times in uniform tangential contact with the printing element 37 during movement of the latter through the positions 37′ and 37″. This insures a uniform application of ink from the inking roll 69 to the entire face of the printing element 37 and thus produces a printed image of the best possible quality. It can be demonstrated that the inking roll 69 should move according to the equation:

$$\epsilon = R - (r/\cos\alpha)$$

where:

$\epsilon$ = the straight-line displacement of the inking roll 69 toward the shaft 52, measured at the axis of the inking roll shaft 261, R = the radial distance between the axis of the shaft 52 and the leading or trailing edge of the printing element 37, r = the radial distance between the axis of shaft 52 and the median line of the printing element 37, and $\alpha$ = the angle between a radial line connecting the axis of shaft 52 to the median line of the printing element 37, and a radial line connecting the shaft 52 to the line of contact between the inking roll and the printing element, in order to maintain tangency with the flat surface of the printing element 37. This equation is incorporated into the values given in Table 1. The radial distances R and r, together with the inking roll displacement $\epsilon$, are shown in FIG. 22 for the middle position 37′ of the printing element. The angle $\alpha$ at this position is zero, since the line of contact between the inking roll 69 and the printing element 37′ is coincident with the median line 334 of the printing element. For purposes of illustration, the angle $\alpha$ has been shown in FIG. 22 for the bottom position 37″ of the printing element.

ELECTRICAL CONTROL CIRCUITRY

Figure 23A:
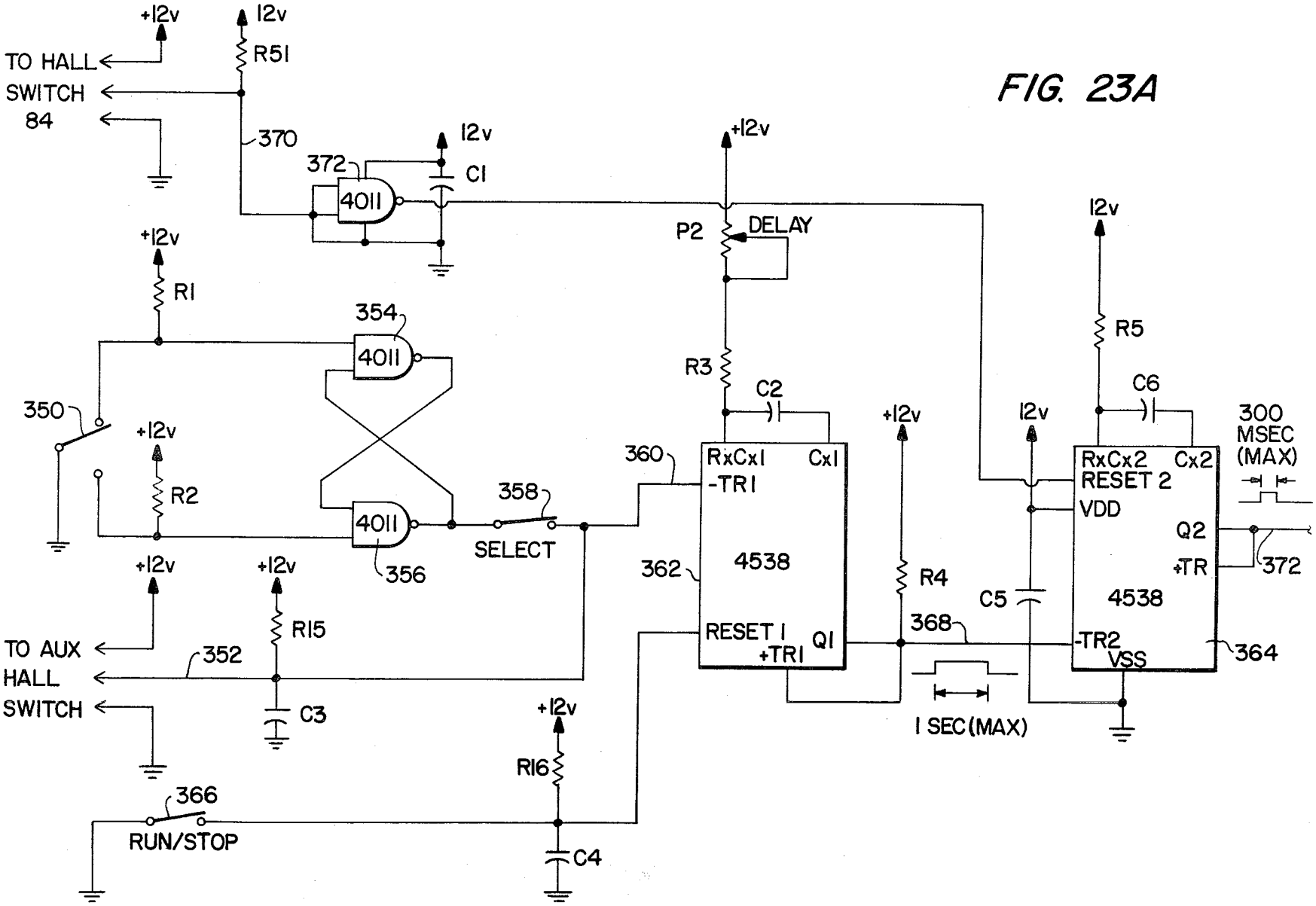
FIGS. 23–25 are schematic diagrams of the electronic circuitry used to control the printing unit of FIGS.1–4.
Figure 23B:
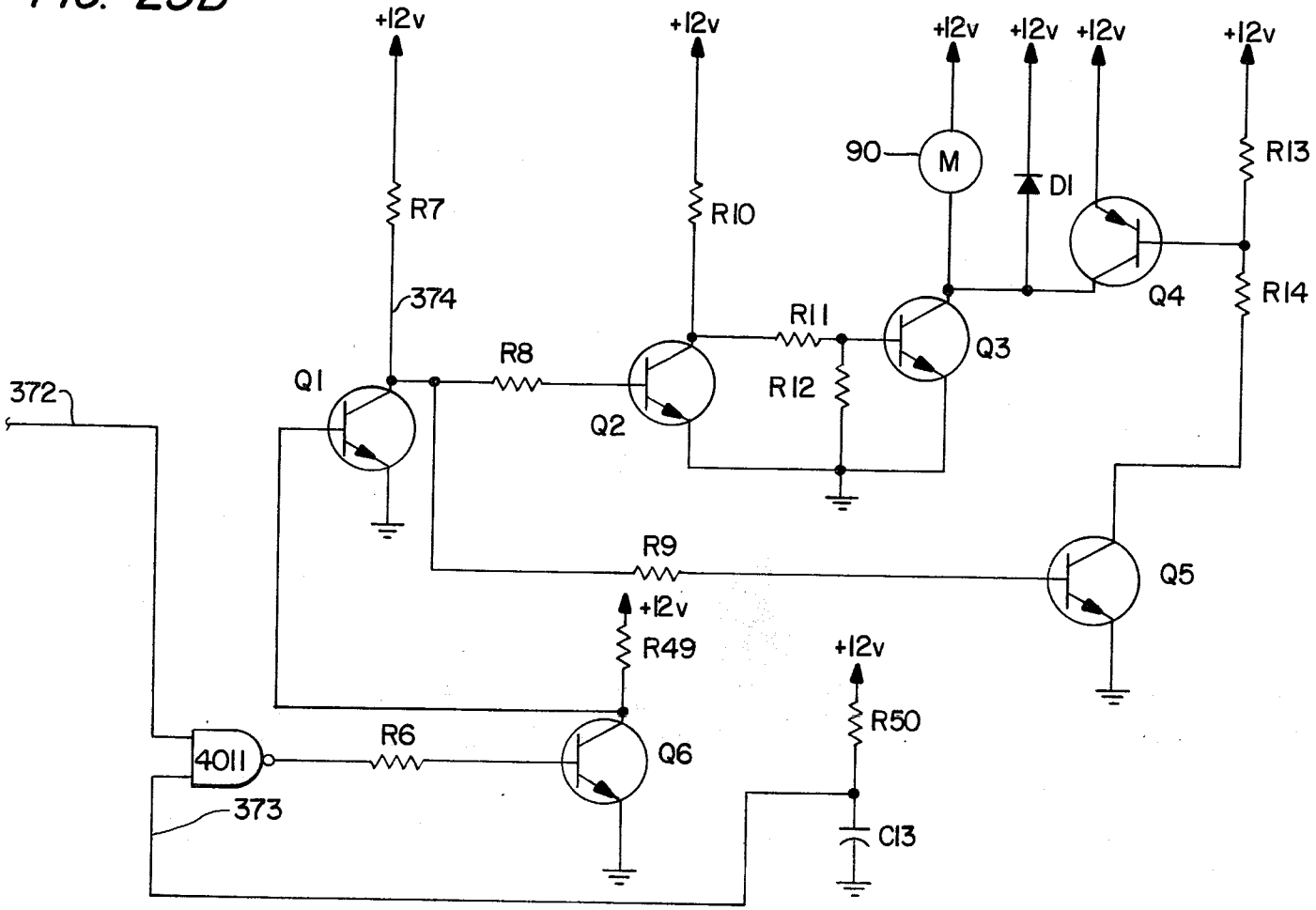
Figure 24:
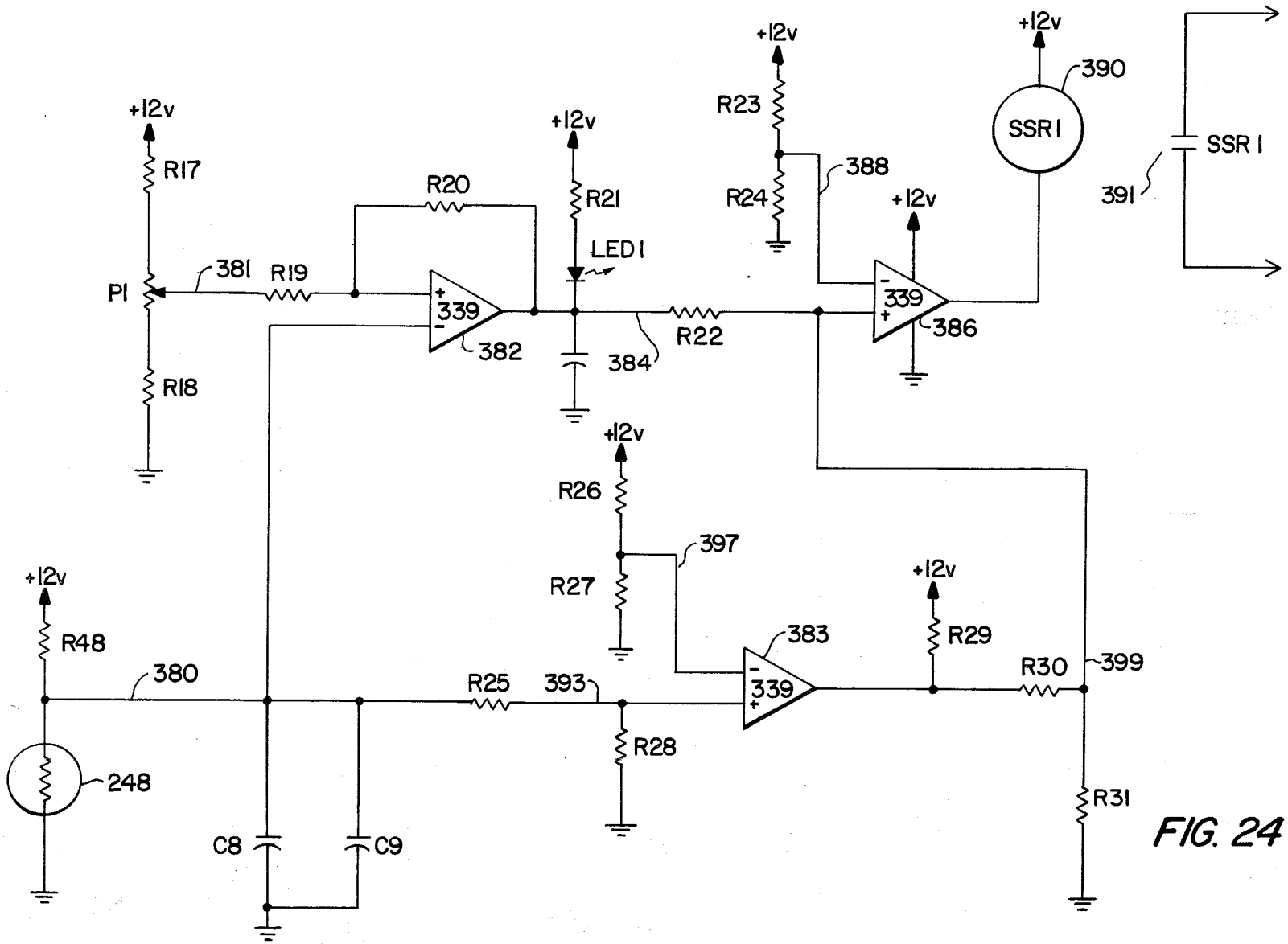
Figure 25:
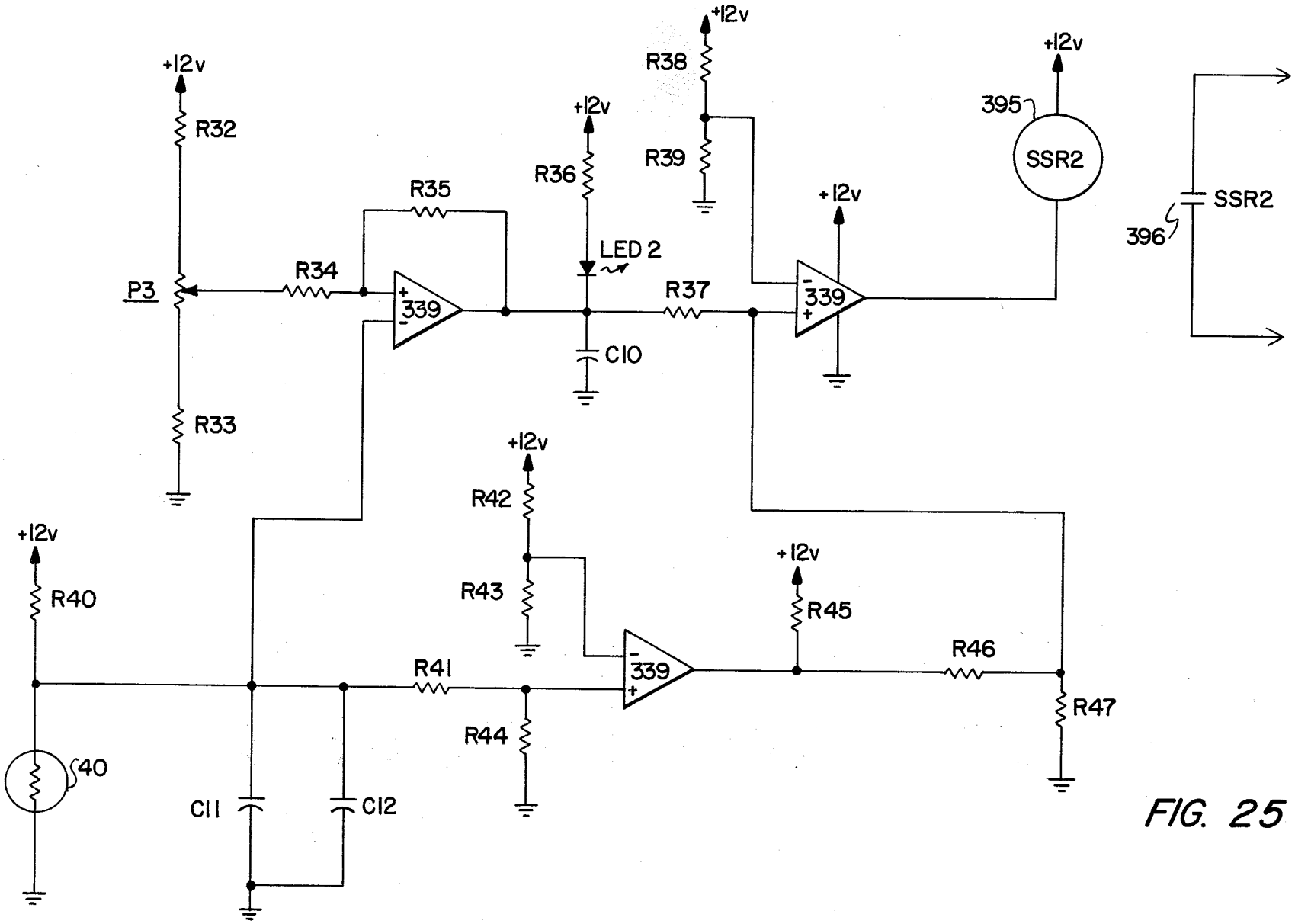

The electrical circuits used for controlling the operation of the printing unit 21 are illustrated schematically in FIGS. 23–25. In these Figures, the numbers given within the symbols for logic gates, comparators, one-shot multivibrators and other electronic components represent commercial component types. Resistor values, capacitor values, and transistor numbers are noted in Table 2.

TABLE 2

| | | | | | |
|---|---|---|---|---|---|
| R1 | 15K | R32 | 1.8K | C1 | 0.1 μF |

TABLE 2-continued

| | | | | | | |
|---|---|---|---|---|---|---|
| R2 | 15K | | R33 | 220Ω | C2 | 1.0 μF |
| R3 | 6.8K | | R34 | 47K | C3 | 0.01 μF |
| R4 | 15K | | R35 | 2.7M | C4 | 0.01 μF |
| R5 | 470K | | R36 | 1K | C5 | 0.01 μF |
| R6 | 15K | | R37 | 100K | C6 | 1.0 μF |
| R7 | 220Ω | (½ watt) | R38 | 100K | C7 | 1.0 μF |
| R8 | 270Ω | | R39 | 1K | C8 | 6.8 μF |
| R9 | 270Ω | | R40 | 5.1K | C9 | 0.01 μF |
| R10 | 68Ω | (3 watt) | R41 | 470K | C10 | 1.0 μF |
| R11 | 33Ω | (½ watt) | R42 | 100K | C11 | 6.8 μF |
| R12 | 68Ω | (3 watt) | R43 | 91K | C12 | 0.01 μF |
| R13 | 68Ω | | R44 | 470K | C13 | 10 μF |
| R14 | 68Ω | (3 watt) | R45 | 6.8K | | |
| R15 | 68K | | R46 | 100K | Q1 | 2N2222A |
| R16 | 15K | | R47 | 1.8K | Q2 | 2N2222A |
| R17 | 1K | | R48 | 5.1K | Q3 | 2N5302 |
| R18 | 150Ω | | R49 | 1K | Q4 | 2N4399 |
| R19 | 47K | | R50 | 330K | Q5 | 2N2222A |
| R20 | 2.7M | | R51 | 15K | Q6 | 2N2222A |
| R21 | 1K | | | | | |
| R22 | 100K | | P1 | 2K | | |
| R23 | 100K | | P2 | 500K | | |
| R24 | 1K | | P3 | 2.5K | | |
| R25 | 470K | | | | | |
| R26 | 100K | | | | | |
| R27 | 91K | | | | | |
| R28 | 470K | | | | | |
| R29 | 6.8K | | | | | |
| R30 | 100K | | | | | |
| R31 | 1.8K | | | | | |

Resistor values are expressed in ohms (Ω), kilohms (K), or megohms (M). All resistors are ¼-watt resistors unless otherwise noted. Capacitor values are expressed in microfarads (μF). The transistor numbers are standard in the industry and will serve to identify specific components. The circuitry of FIGS. 23–25 is preferably contained in a control box (not shown) separate from the printer housing 21 and connected thereto by appropriate electrical leads. The various potentiometers, switches and LEDs incorporated into the circuitry of FIGS. 20–22 are preferably mounted on the front panel of the control box for convenient access by a human operator.

The circuit for controlling the starting and stopping of the printing member drive motor 90 is illustrated in FIG. 23. The start input signal may be provided either by a single pole, double throw switch 350 mounted for actuation by a moving part of the article conveyor, or by a similarly mounted auxiliary Hall effect switch (not shown) which provides a signal input on line 352. Cross-connected NAND gates 354 and 356 provide debouncing for the switch 350. A single pole, single throw SELECT switch 358 is provided to select either the double-throw switch 350 or the auxiliary Hall effect switch as the source of the start input signal. Assuming for example that the SELECT switch 358 is in the closed position, movement of the switch 350 to the bottom or normally-open position will cause line 360 to go low. This will trigger the negative edge input -TR1 of the one-shot multivibrator 362. If the RUN/STOP switch 266 is in the open position, the reset input of the one-shot 362 is disabled. Under these conditions the output Q1 of the one-shot 362 will transition to a high logic state for a time interval determined by the setting of the DELAY potentiometer P2. This time interval can be adjusted between 0 and 1 second and serves as a delay interval between the signal from the switch 350 and the actual starting of the printing unit. This is useful in cases where, for example, the switch 350 is triggered by the article or web conveyor slightly in advance of the actual stopping of the conveyor.

With further reference to FIG. 23, a line 368 connects the output Q1 of the one-shot 362 to the negative edge input of a further one-shot multivibrator 364. When the delay period set by the potentiometer P2 expires, the output Q1 of the one-shot 362 goes low and triggers the negative edge input of the one-shot 364. At this point the vane 82 of FIG. 1 has not yet actuated the Hall switch 84. Therefore, a low logic level exists on line 370 and a high logic level exists at the reset input of the one-shot 364 due to the inverter 372. With the reset input disabled, the one-shot 364 responds to the low logic level on line 368 by producing a high logic level at its output Q2. The high logic level at Q2 is limited to a maximum duration of 300 milliseconds by the timing circuit formed by resistor R5 and capacitor C6, although a signal from the Hall switch 84, indicating the approaching end of the printing cycle, will usually occur well before the expiration of the 300-millisecond interval. The signal from Hall switch 84 appears as a high logic level on line 370, which is inverted by the inverter 372 and applied as a low logic level to the reset input of the one-shot 364. This enables the reset input of the one-shot 364, causing the output Q2 to transition immediately to the low logic state.

The duration of the high logic level at the output Q2 of the one-shot 364 defines the operating interval of the D.C. drive motor 90 used in the printing unit 21. To this end, the Q2 output on line 372 is connected to one input of a NAND gate 373. The second input of the NAND gate 373 is connected to the node between resistor R50 and capacitor C13. The output of the NAND gate 373 is connected to the base of a transistor Q6 through a resistor R6. The collector of transistor Q6 is connected to the base of transistor Q1. A high logic level on line 372, as will occur during steady-state operating conditions when the one-shot 364 is triggered, will cause transistor Q1 to turn on. This reduces the voltage on its collector 374 and turns transistor Q2 off. With the collector of transistor Q2 now disconnected from ground, the base of transistor Q3 is brought high and that transistor turns on. This establishes continuity between the 12-volt supply potential, the printing member drive motor 90, and ground. This causes the motor 90 to operate, which sequences the printing unit 21 through the sequence of operations illustrated in FIGS. 5–12. Termination of the high logic level on line 372 causes transistor Q1 to turn off, transistor Q2 to turn on, and transistor Q3 to turn off, which removes power from the motor 90. This occurs near the end of the printing cycle when the vane 82 aligns with the Hall effect switch 84. When transistor Q1 is off, base current is provided to transistor Q5, which causes that transistor to turn on. The collector current to transistor Q5 passes through a voltage divider consisting of resistors R13 and R14, which applies a base voltage to transistor Q4. Transistor Q4 is thereby turned on, which shorts the armature of the motor 90. This provides a dynamic braking effect which stops the motor 90 in a relatively short period of time, thereby ending the printing cycle. Diode D1 protects the transistor Q3 from excessive reverse bias during turn-off of the motor 90.

Initial power-up conditions may cause random triggering of the one-shots 362 and 364 due to sudden voltage changes, which would initiate an immediate printing cycle if the line 372 were to be connected directly to the base of transistor Q1. This is prevented by the RC timing circuit formed by resistor R50 and capacitor C13. Until the capacitor C13 charges, which requirea about 2 seconds, one input of the NAND gate 373 is held low. As a result, the output of the NAND gate 373 is maintained at a high logic level, keeping transistor Q6 on the transistor Q1 off regardless of the state of line 372. When the capacitor C13 charges, the lower input of the NAND gate 373 is brought high. Subsequent high logic levels on line 372 will now enable the NAND gate 373, forcing its output to go low and transistor Q6 to turn off. Base current is then applied to transistor Q1, causing that transistor to turn on and the motor 90 to operate as described previously.

FIG. 24 is a schematic diagram of the circuit used to control the temperature of the inking roll heater block 232 of FIG. 18 by means of the thermistor 248 and resistance heating elements 240, 242 and 244. The thermistor 248 is a negative temperature coefficient device characterized by decreasing resistance with increasing temperature. The thermistor 248 is provided as part of a voltage divider which includes a resistor R48. The voltage at node 380 is applied to the inverting input of a comparator 382. The non-inverting input of the comparator 382 is connected to the tap 381 of a potentiometer P1 through a resistor R19. The potentiometer P1 is part of a variable voltage divider including the resistors R17 and R18. The setting of the potentiometer P1 will determine the temperature maintained by the circuit of FIG. 24, with the resistors R17 and R18 defining the upper and lower limits of the temperature range. The comparator 382 compares the reference voltage from the potentiometer with the voltage on the node 380, the latter being indicative of the temperature of the thermistor 248. The output voltage on node 384, which will either be high or low depending upon the relative magnitudes of the input voltages, is applied through a resistor R22 to the non-inverting input of a further comparator 386. The inverting input of the comparator 386 is connected to a reference voltage which is produced on the node 388 by the series resistors R23 and R24. Comparator 386 compares the output voltage of the op amp 382 with the reference voltage on node 388 and produces an output signal which is applied to the negative input terminal of a solid state relay 390. The positive input terminal of the solid state relay 390 is connected to the 12-volt supply potential. The triac output 391 of the solid state relay 390 controls the power to the parallel-connected resistance heating elements 240, 242 and 244 embedded in the inking roll heater block 232 of FIG. 18.

As the temperature of the thermistor 248 decreases, thereby increasing its resistance, the voltage on node 380 will increase. Capacitors C8 and C9 ensure that the thermistor output voltage on node 380 changes only gradually, avoiding rapid and unnecessary switching of the solid state rely 390. When the voltage on node 380 rises above the reference voltage produced at the non-inverting input of the comparator 382, the output of the comparator 382 goes low, causing light-emitting dode LED1 to be forward biased. At the same time, the low output of comparator 382 causes the voltage on the non-inverting input of the comparator 386 to drop below the reference voltage on node 388. This causes the output of the comparator 386 to go low, thereby operating the solid state relay 390 and applying power to the resistance heating elements 240, 242 and 244 of FIG. 18. The illuminated condition of LED1 indicates that current is being supplied to the resistance heating elements 240, 242 and 244 at this time. When the inking roll heater block 232 of FIG. 18 has reached the desired temperature, the outputs of the comparators 382 and 386 are restored to a high logic level and LED1 is turned off. The triac output 391 of the solid state relay 390 is now opened, causing power to be removed from the resistance heating elements 240, 242 and 244 of FIG. 18.

It will be apparent that an abnormal open-circuit condition at the thermistor 248, arising for example from a defective thermistor or a poor circuit connection, will give the appearance of a persisting low thermistor temperature. This would result in current being applied continuously to the resistance heating elements 240, 242 and 244 of FIG. 18, and hence in an excessively high temperature of the inking roll heater block 232. To protect against this possibility, the thermistor voltage on node 380 is applied to a voltage divider consisting of resistors R25 and R28. The resulting voltage on node 393 is applied to the non-inverting input of a comparator 383. The inverting input of the comparator 383 is connected to the node 397 of a further voltage divider consisting of resistors R26 and R27. When the thermistor 248 is functioning normally, the voltage on node 393 is less than the voltage on node 397, which maintains the output of the comparator 383 at a low logic level. However, when the thermistor impedance becomes abnormally high, the voltage on node 393 rises above the voltage on node 397, causing the output of the comparator 383 to transition to a high logic level. Under these conditions, current flows in a series path through the resistors R29, R30 and R31. The node 399 between resistors R30 and R31 is connected to the non-inverting input of the comparator 386. The voltage on the node 399 now becomes higher than the voltage on node 388, which causes the output of the comparator 386 to remain high regardless of the output state of the comparator 382. The output 391 of the solid state relay 390 therefore remains open and no current is supplied to the resistance heating elements 240, 242 and 244 of FIG. 18.

The temperature control circuit for the printing member heater block 34 of FIG. 14 is illustrated in FIG. 25. This circuit is in most respects the same as the circuit of FIG. 24, except that the values of certain resistors and potentiometers are different as a consequence of the fact that the printing member heater block 34 of FIG. 14 is preferably maintained at a lower temperature than the inking roll heater block 232 of FIG. 18. Apart from that, the operation of both circuits is the same and therefore no detailed description of FIG. 25 will be necessary. It will suffice to point out that the triac output 396 of the solid state relay 395 in FIG. 25 delivers current to the parallel-connected resistance heating elements 36 and 386 of FIG. 14 in accordance with the temperature of the thermistor 40. As in the FIG. 24 circuit, a potentiometer P3 is included for setting the desired temperature of the printing member heater block 34, and a light-emitting diode LED2 is provided for visually indicating periods when current is being supplied to the resistance heating elements 36 and 38.

Although the present invention has been described with reference to a preferred embodiment, it should be understood that the invention is not limited to the details thereof. A number of possible substitutions and modifications have been suggested in the foregoing detailed description, and others will occur to those of ordinary skill in the art. All such substitutions and modifications are intended to fall within the scope of the invention as defined in the appended claims.

What is claimed is:

1. Printing apparatus comprising:

(a) a supporting frame, (b) a printing member arranged for back-and-forth pivoting movement relative to said supporting frame along an arcuate path between a first position in proximity to a surface to be printed and a second position remote from said surface, said pivoting movement being centered about an axis, (c) a printing element carried by said printing member for forming printed images on the surface to be printed, (d) drive means for cyclically moving said printing member in opposite directions along said arcuate path from the first position to the second position and then back to the first position, said drive means including a source of rotary power having an output shaft, (e) ink applying means mounted for rocking movement relative to said supporting frame along a path which intersects the arcuate path of the printing member, said ink applying means including a rotatable inking roll, (f) actuating means coupled to said drive means for cyclically rocking said ink applying means in timed relation to the arcuate movement of the printing member, said rocking of the ink applying means being such that the inking roll is maintained out of contact with the printing element durin movement of the printing member in one direction and is brought into rolling contact with the printing device in order to apply ink thereto during movement of the printing member in the opposite direction, said actuating means comprising:

(1) a rotatable cam affixed to the output shaft of the rotary power source, (2) a follower arm having acam follower at one end thereof, said follower arm being attached at its opposite end to the ink applying means in order to impart rocking motion thereto in response to the rotation of the cam, and (3) biasing means for urging said cam follower into contact with said cam.

2. Printing apparatus as claimed in claim 1, wherein the printing element carried by the printing member is substantially in the form of a flat planar surface having raised printing indicia thereon and including leading and trailing edges, said leading edge being the edge which first contacts the inking roll during arcuate movement of the printing member between the first and second positions, and said trailing edge being the edge which last contacts the inking roll during said movement of the printing member, and wherein the contour of the cam is such that the inking roll moves gradually closer to the pivot axis of the printing member as the line of contact between the inking roll and the printing element moves from the leading edge of the printing element to the median line between the leading and trailing edges, and moves gradually away from the pivot axis of the printing member as the line of contact between the inking roll and the printing element moves from said median line to the trailing edge of the printing element.

3. Printing apparatus as claimed in claim 2, wherein the contour of the cam is such that the inking roll moves substantially in accordance with the equation:

$$\epsilon = R - (r/\cos \alpha)$$

wherein:

$\epsilon$ = the amount of movement of the inking roll toward the pivot axis of the printing member, R = the radial distance between the pivot axis of the printing member and the leading or trailing edge of the printing element, r = the radial distance between the pivot axis of the printing member and the median line of the printing element, and $\alpha$ = the angle between a radial line connecting the pivot axis of the printing member to the median line of the printing element and a radial line connecting the pivot axis of the printing member to the line of contact between the inking roll and the printing element.

4. Printing apparatus as claimed in claim 1 or 2, wherein said ink applying means further comprises a housing for supporting and partially enclosing said inking roll, said housing and said inking roll being movable as a unit with respect to the supporting frame.

5. Printing apparatus as claimed in claim 4, wherein the housing of said ink applying means is pivotally mounted with respect to the supporting frame about a pivot axis offset from the axis of the inking roll, and wherein the rocking movement of the ink applying means arises from pivoting motion of said housing about the pivot axis thereof.

6. Printing apparatus as claimed in claim 5, wherein said ink applying means further comprises an electric motor for imparting continuous rotary motion to the inking roll, said electric motor being movable with the housing of said ink applying means.

7. Printing apparatus as claimed in claim 6, whrein said ink applying means further comprises a shaft coupled to said electric motor for imparting continuous rotary motion to the inking roll, and wherein said inking roll includes a central hub, said shaft being received within said hub with a running fit to allow slippage between said hub and said shaft when the inking roll is brought into rolling contact with the printing element.

8. Printing apparatus as claimed in claim 1 or 2, wherein the actuating means is effective to impart rocking movement to the ink applying means in a manner such that the inking roll is maintained out of contact with the printing element during movement of the printing member in the direction from the first position to the second position, and is brought into contact with the printing element in order to apply ink thereto during movement of the printing member in the direction from the second position to the first position, such contact occurring when the printing member is at an intermediate point between the first and second positions.

9. Printing apparatus as claimed in claim 8, wherein the ink applying means further comprises heating means for maintaining the inking roll at an elevated temperature.

10. Printing apparatus as claimed in claim 9, wherein the printing member further comprises heating means for maintaining the printing element at an elevated temperature.

11. Printing apparatus comprising:

(a) a supporting frame, (b) support means movable along a substantially straight line path with respect to said supporting frame between an operative position in relative proximity to a surface to be printed and a retracted position more remote from said surface, (c) resilient biasing means for normally maintaining said support means in the retracted position, and for allowing said support means to move to the operative position in response to a force sufficient to overcome said resilient biasing means, (d) a printing member pivotally supported by said support means for back-and-forth pivoting movement relative to the supporting frame along an arcuate path between a first position in proximity to a surface to be printed and a second position remote from said surface, said printing member carrying a printing element for forming a printed image on the surface to be printed, (e) means for applying ink to the printing element during the movement of the printing member between the first and second positions, (f) stop means for temporarily arresting the arcuate motion of the printing member at the first position, and (g) drive means for cyclically moving the printing member along said arcuate path from the first position to the second position and then back to the first position, said drive means also being effective to momentarily overcome the resilient means when the arcuate motion of the printing member is arrested at the first position by the stop means, and to thereby cause the support means and the printing member to move along said substantially straight line path to bring the printing element into contact with the surface to be printed.

12. Printing apparatus as claimed in claim 11, wherein said drive means comprises:

(a) a source of rotary power having an output shaft, (b) a crank disk affixed to said output shaft, and (c) a connecting link pivotally attached at one end thereof to a point on said crank disk and pivotally attached at the opposite end thereof to a point on the printing member.

13. Printing apparatus as claimed in claim 12, wherein said support means comprises:

(a) a mounting block, (b) bearing means carried by said mounting block for pivotally supporting the printing member, (c) means including at least one slide rod for slidably supporting said mounting block with respect to the supporting frame.

14. Printing apparatus as claimed in claim 13, wherein said slide rod is rigidly affixed to said mounting block, and wherein the supporting frame includes bearing means for slidably receiving the slide rod.

15. Printing apparatus as claimed in claim 14, wherein the stop means is a part of said mounting block.

16. Printing apparatus as claimed in claim 15, wherein the stop means comprises a projecting abutment forming a part of said mounting block and extending into the path of arcuate movement of the printing member, said projecting abutment being positioned to arrest the arcuate motion of the printing member at the first position.

17. A process for printing on a surface using an inking roll which is arranged for continuous powered rotation in a fixed direction and a printing member which is arranged for pivoting movement about an axis along an arcuate path in proximity to the inking roll, said printing member carrying a flat printing element having leading and trailing edges, comprising:

(a) cyclically moving the printing member in opposite directions along said arcuate path in a back-and-forth manner, whereby said printing element is brought in proximity to the inking roll twice during each cycle of movement of the printing member;

(b) maintaining the inking roll out of contact with the printing element during movement of the printing member in the direction opposite to the direction of rotation of the inking roll;

(c) moving the inking roll into contact with the printing element in order to apply ink thereto during movement of the printing member in the direction of rotation of the inking roll, said movement of the inking roll comprising gradual movement of the inking roll closer to the printing member axis followed by gradual movement of the inking roll away from the printing member axis as the line of contact between the inking roll and the printing element moves from the leading edge of the printing element to the trailing edge thereof; and (d) bringing the inked printing element into contact with the surface to be printed.

18. A process as claimed in claim 17, wherein the printing member axis is parallel to the plane of the printing element and is intersected by a line drawn normal to the plane of the printing element and passing through the median line between the leading and trailing edges of the printing element, and wherein the movement of the inking roll closer to and away from the printing member axis is carried out substantially in accordance with the equation:

$$\epsilon = R - (r/\cos \alpha)$$

wherein:

$\epsilon$ = the amount of movement of the inking roll toward the printing member axis, R = the radial distance between the printing member axis and the leading or trailing edge of the printing element, r = the radial distance between the printing member axis and the median line of the printing element, and $\alpha$ = the angle between a radial line connecting the printing member axis to the median line of the printing element and a radical line connecting the printing member axis to the line of contact between the inking roll and the printing element.

* * * * *